US012565834B2

(12) United States Patent
Wu et al.

(10) Patent No.: US 12,565,834 B2
(45) Date of Patent: Mar. 3, 2026

(54) ELECTROMAGNETIC ANTENNAS SYSTEM AND METHOD OF USE

(71) Applicant: Bench Tree Group, LLC, Georgetown, TX (US)

(72) Inventors: Jian-Qun Wu, Kingwood, TX (US); Pedro Segura, Round Rock, TX (US); Larry Thompson, Georgetown, TX (US)

(73) Assignee: Bench Tree Group, LLC, Georgetown, TX (US)

( * ) Notice: Subject to any disclaimer, the term of this patent is extended or adjusted under 35 U.S.C. 154(b) by 0 days.

(21) Appl. No.: 18/949,160

(22) Filed: Nov. 15, 2024

(65) Prior Publication Data

US 2025/0163801 A1 May 22, 2025

Related U.S. Application Data

(60) Provisional application No. 63/600,326, filed on Nov. 17, 2023.

(51) Int. Cl.
*E21B 47/13* (2012.01)
*E21B 47/01* (2012.01)
*E21B 49/00* (2006.01)

(52) U.S. Cl.
CPC ..... *E21B 47/13* (2020.05); *E21B 47/01* (2013.01); *E21B 49/00* (2013.01)

(58) Field of Classification Search
CPC ..... E21B 47/13; E21B 47/01; E21B 49/00
See application file for complete search history.

(56) References Cited

U.S. PATENT DOCUMENTS

2003/0028356 A1* 2/2003 Denny ..... G01V 13/00 714/E11.019
2004/0012392 A1* 1/2004 McCormick ..... G01V 3/30 324/338

(Continued)

FOREIGN PATENT DOCUMENTS

WO WO 2021/126604 A1 6/2021

OTHER PUBLICATIONS

USPTO Acting as International Searching Authority, International Search Repot and Written Opinion regarding International patent application No. PCT/US2024/056203, dated Jan. 17, 2025.

*Primary Examiner* — Amine Benlagsir
(74) *Attorney, Agent, or Firm* — DUNLAP CODDING, P.C.

(57) ABSTRACT

A system of electromagnetic antennas including antennas constructed on the surface sections of a steel cylinder and made of electric antenna wires around magnetically highly permeable magnetic cores. The permeability of magnetic material is controlled by a separate electric wire winding system on the magnetic core. An antenna is turned off by a current in the windings used to saturate the magnetic core in the antenna. A saturated magnetic core has an effective relative permeability of one for electromagnetic field. Zero current in the windings of an antenna restores the high permeability of the magnetic core and activates the antenna. For a pair of antennas close by with possible mutual coupling, an on-off sequence is used so that one antenna is active and the other is off. Mutual coupling between the pair of antennas is eliminated. Air-hanging calibration is unneeded on tools utilizing disclosed antenna systems.

15 Claims, 14 Drawing Sheets

(56) References Cited

U.S. PATENT DOCUMENTS

| | | | | |
|---|---|---|---|---|
| 2004/0239521 | A1* | 12/2004 | Zierolf | G01V 3/30 340/854.1 |
| 2005/0150691 | A1* | 7/2005 | Schultz | H01L 23/3157 175/57 |
| 2005/0194134 | A1* | 9/2005 | McGregor | E21B 49/006 166/264 |
| 2006/0000604 | A1* | 1/2006 | Jenkins | E21B 47/13 166/250.11 |
| 2006/0131376 | A1* | 6/2006 | Bargach | E21B 49/06 702/6 |
| 2006/0175404 | A1* | 8/2006 | Zierolf | E21B 17/006 235/385 |
| 2006/0290529 | A1* | 12/2006 | Flanagan | G01V 11/002 340/854.6 |
| 2007/0182408 | A1 | 8/2007 | Blanz et al. | |
| 2008/0068209 | A1* | 3/2008 | Sugiyama | G06K 7/0008 340/853.2 |
| 2010/0134257 | A1* | 6/2010 | Puleston | G06K 7/0008 340/10.4 |
| 2012/0133526 | A1* | 5/2012 | Christiansen | G01V 15/00 340/854.6 |
| 2021/0071520 | A1* | 3/2021 | Øy | E21B 47/017 |
| 2023/0238680 | A1 | 7/2023 | Wu | |

* cited by examiner

ELECTROMAGNETIC ANTENNAS SYSTEM AND METHOD OF USE

CROSS-REFERENCE TO RELATED APPLICATIONS

This application claims benefit of U.S. Provisional Application No. 63/600,326 filed on Nov. 17, 2023, the contents of which are hereby incorporated herein by reference in their entirety.

BACKGROUND ART

In drilling a well for oil and gas exploration and production, various sensors installed on a drill string are used to measure the properties of formation around the well bore during the drilling process. The measurements are used to evaluate the geological properties of the formation. This operation is referred to as Logging-While-Drilling (LWD). A sensor system for LWD is called a LWD tool.

Traditionally LWD measurements are used for the purpose of formation evaluation. Lately LWD measurements are used to determine the geological structure of the formation near a well section being drilled relative to the well section. The positional information of the formation structure relative to a well section is used to determine the course of action for drilling the next section of the well to maximize hydrocarbon production potential. This drilling process is called geological steering (geosteering).

One of the most prominent LWD sensors for both formation evaluation and geosteering is the wave propagation resistivity tool. A LWD resistivity tool is a cylindrical segment with transmitter and receiver antennas. The segment is connected to and becomes a section of a drill string. A transmitter generates an electromagnetic field at a frequency. The field propagates through the borehole and formation region near the tool. The electromagnetic field values at one or more receiver locations some distance away along the tool's cylindrical axis from the transmitter are measured. When multiple transmitters are used, transmitters are usually turned on one at a time and measurements are made simultaneously in all receivers designed for receiving the signal from the transmitting antenna.

The most fundamental measurement of a wave propagation resistivity tool is the measurement between a pair of transmitter and receiver at a frequency. The measurement is sensitive to the frequency, distance between the transmitter and receiver, borehole environment, and formation properties. Measurements from multiple transmitter-receiver pairs can be combined to yield a single composite measurement to be sensitive to a particular parameter of interest.

Antenna spacing, electromagnetic wave frequencies, antenna activation sequences, and measurement combinations are carefully chosen to meet the performance objectives of a LWD resistivity tool.

The most popular and useful composite measurement comes from a system of two transmitters and two receivers. The two receivers are located in between the two transmitters and are close to each other. The system of antennas is schematically depicted in FIG. 1. Each antenna is schematically represented by a wire loop. The system includes transmitters T1 and T2 shown as loops 101 and 104. Additionally, the system includes two receivers R1 and R2 shown as loops 102 and 103. The loops 101, 102, 103 and 104 are centered on an axis 105. The axis 105 is, in general, the centerline of the resistivity tool which the transmitters T1 and T2, and the receivers R1 and R2 are part of. For clarity, the antenna structure other than the wire loops 101, 102, 103 and 104 are not shown.

During a measurement cycle, the transmitter T1 is first turned on at a particular frequency. The electromagnetic field signals at the two receivers R1 and R2 are measured simultaneously. Then T1 is turned off and T2 is turned on at the same frequency. Again, the signals at the two receivers R1 and R2 are measured. The phase difference and amplitude ratio between the signals of R1 and R2 from T1 are averaged with those of R2 and R1 from T2. The combined measurements of phase and amplitude are called compensated differential measurements. Compensation means that the receiver differences in phase in degrees and amplitude in dBs from the two transmitters T1 and T2 are averaged. The differential measurement from a single transmitter T1 or T2 is sometimes called uncompensated measurement or is referred to as a measurement without compensation. The measurement between one pair of transmitter and receiver (e.g., transmitter T1 and receiver R1) is sensitive to borehole and formation properties in the region between the transmitter T1 and receiver R1 in addition to transmitter phase and power. The differential measurements between the two receivers R1 and R2 when one transmitter is on (e.g., transmitter T1) are nominally independent of the phase and power level of the transmitter T1 or T2, as long as the transmitter power is high enough so that the signals at the receivers R1 and R2 meet the signal-to-noise requirement. Furthermore, the differential measurements are insensitive to the resistivity of borehole and are mainly sensitive to the electromagnetic parameters of the formation region in-between the two receivers R1 and R2. The desirable characteristic of differential measurement being insensitive to borehole properties is called borehole rejection in the industry and was an important motivation for adopting the differential measurement.

In general, the electromagnetic field at a receiver location is shifted in phase and altered in amplitude by the receiver antenna and receiver electronics. The measured receiver signal differs from the field signal unperturbed by the receiver (such as R1 or R2 depicted in FIG. 1) in question by a phase shift and an amplitude scaling. The shift and scaling are called an antenna gain. The gain can be represented by a single complex scaling factor. A receiver measurement is the unperturbed field signal multiplied by the complex scaling factor. An antenna gain is a property of the antenna and does not carry information about the properties of the formation near a resistivity tool. Part of the gain is controlled and designed behavior of the receiver system in order to maximize the accuracy of receiver measurements. The rest may be uncontrolled and may be unknown. The controlled gains can be properly accounted for or automatically canceled in the differential receiver measurement. The uncontrolled gain may be eliminated in order to extract information about formation properties from receiver measurements. Hereinafter the uncontrolled gains will be referred to as antenna gains unless pointed out specifically otherwise.

Differential measurement between a pair of receivers spaced apart along a resistivity tool's axis is mainly sensitive to properties of a formation region in a layer radially away from the borehole and in a longitudinal section between the two receivers. The radial distance of the region is called the depth of investigation (DOI). An uncompensated differential measurement can weakly depend on the properties of the formation between the transmitter and the two receivers. A compensated differential measurement, thus, weakly depends on the properties of the two formation sections on both sides of the two-receiver region. Nonetheless, the midpoint between the two receivers is customarily designated as the measurement point or measure point of the differential measurement. With or without compensation, the differential measurement is used to detect variations of formation properties along the well trajectory. This detection capability is termed vertical resolution in the industry.

In early days, most oil and gas wells are vertical and the formation beds were assumed to be horizontal. The vertical resolution is also called bed resolution. Even though many wells drilled nowadays are not vertical and do not necessarily intersect formation beds at a right angle, the terms of vertical resolution or bed resolution are still being used to quantify a capability of a tool to measure the variation of formation properties along a well.

The differential measurements between a pair of receivers on the electromagnetic field generated from a single transmitter are the phase shift and amplitude ratio of the unperturbed field values at the two receiver locations plus the difference in total gains between the two receivers. The part from receiver gains must be removed from the differential measurement for the correct interpretation of formation properties.

The compensated differential measurements from the four-antenna system described earlier in relation to FIG. 1 are free of antenna gains. In terms of phase shift in degrees and amplitude in dBs, the gains in the differential measurement from one transmitter T1 or T2 are the same in magnitude but opposite in sign as those of the other transmitter T2 or T1. The averaging of the two differentials removes the antenna gains. The receiver antenna gains are independent of field values being measured. The gain removal through compensation does not rely on the uncompensated differentials of unperturbed field values from one transmitter T1 or T2 being equal to those of the other transmitter T2 or T1. As such the compensation removes gains completely regardless whether the two transmitters T1 and T2 are symmetrically located about the center of the two receivers R1 and R2. The compensation also removes receiver gains in a four-antenna system where the two transmitters T1 and T2 and the two receivers R1 and R2 are not located along a single axis.

Compensation also makes it unnecessary to properly account for controlled and designed gains in receiver antenna systems since they are also removed in the process of compensation computation. As such the compensated measurements are free of the effects of antenna gains of any kind.

Because of the advantages offered by the compensated differential measurements, the two-transmitter and two-receiver systems have become the most popular building blocks of modern wave propagation resistivity tools. Hereinafter, a two-transmitter (T1 and T2) and two-receiver (R1 and R2) system such as the one depicted in FIG. 1 will be referred to as a Compensated Difference Construct (CDC). In a Compensated Difference Construct (CDC) the two receivers R1 and R2 are in between the two transmitters T1 and T2.

A four-antenna construct similar to a compensated difference construct with the two transmitters T1 and T2 being in between the two receivers R1 and R2 will be referred to as the Reciprocal Compensated Difference Construct (RCDC). FIG. 2 is a schematic view of a RCDC. Similarly to FIG. 1, antennas are schematically represented by antenna loops 106, 107, 108, and 109. Loops 106 and 109 are the receiver antennas (receivers) R1 and R2. The two transmitter antennas (transmitters) T1 and T2 are loops 107 and 108. In this system, the antenna loops 106, 107, 108, and 109 are centered on an axis labeled 110.

As known in the art, each formation layer is considered to be a "bed". A thickness of a thinnest bed whose geological property can still be detected is referred to in the art as a "bed resolution." The bed resolution of a differential measurement is limited by the distance between the two receivers R1 and R2. In order to get fine vertical resolution or thin bed resolution the two receiver antennas used for differential measurements are placed closely together. The receivers for 2 MHz signals are between six to eight inches. Because of the close proximity of the receivers R1 and R2 to each other, there is a non-negligible mutual coupling between the pair of receivers R1 and R2. The mutual coupling field is added to the original field at the receiver location. The total field is measured by the receiver R1 and/or R2. The mutual coupling effect must be properly accounted for or eliminated so that the compensated differential measurement is determined by formation properties only.

The effect of mutual coupling between a pair of closely positioned antennas is not reduced or eliminated by a tool design employing reciprocity. According to the reciprocity principle on antenna efficiency, a receiver is also a transmitter with the same efficiency and vice versa. On an electromagnetic field, the reciprocity principle is, if the positions and orientations of a pair of transmitter and receiver antennas are interchanged, the receiver measurement remains the same under many conditions. The measurement from each transmitter-receiver pair is the building block of any composite measurements. Mutual coupling takes place in a measurement from a single transmitter-receiver pair when there is an excitable antenna used for other purpose near the receiver or the transmitter in the pair. The mutual coupling in the measurement is unchanged if the roles of transmitter and receiver in the pair are reversed.

The compensated differential measurement obtained from antennas in a compensated difference construct is identical to that of a reciprocal compensated difference construct provided that the RCDC is identical to the CDC except that the receivers and transmitters in the CDC are used as transmitters and receivers in the RCDC, respectively. The two transmitters in the reciprocal construct are energized one at a time. The two receivers are far apart in the reciprocal construct and there is no mutual coupling between receivers. However, there is now a mutual coupling between the two closely spaced transmitters in the reciprocal construct. When one transmitter (for example, transmitter T1) is energized, its field induces a current in the nearby transmitter T2 which in turn generates electromagnetic field at receiver locations. The receiver measurements include both the field component from the purposely energized transmitter T1 and the field component from the other transmitter T2. The characteristic and magnitude of mutual coupling in the measurement from antennas in a reciprocal compensated difference construct is unchanged from that of a compensated difference construct. Mutual coupling is caused by two antennas being too close to each other. It does not matter whether either of the antennas is a receiver or transmitter. The mutual coupling field in the measurement is invariant under reciprocity.

In terms of measurement physics, there is no difference between a compensated difference construct and a reciprocal compensated difference construct. One construct is not more superior to the other. The measurement physics between a CDC and a RCDC are mutually reciprocal to each other. In terms of engineering, receiver electronics are more sophisticated and more expensive than those of transmitter electronics. For a resistivity tool with a single compensated difference measurement there is no difference in measurement physics and tool cost between the two constructs. Modern LWD wave propagation resistivity tools, however, usually utilize multiple compensated difference constructs with one pair of closely-spaced antenna as receivers common to several constructs. The constructs sharing one pair of receivers form a super set of antennas. The usage of the common receivers ensures that the multiple compensated difference measurements are made at a single measure point along a well path. This tool design minimizes the number of receivers and the cost associated with receiver electronics. As such, most tools use compensated difference constructs of antennas. The number of steps in a measurement cycle at a frequency is equal to the number of transmitters in the super set. During each step only one transmitter is energized. The length of time of a measurement cycle is directly proportional to the number of transmitters in the super set. One advantage of using a super set of antennas of reciprocal compensated difference constructs is that there are only two transmitters in the systems. The two transmitters are energized one at a time while all the receivers are turned on all the time. At one frequency there are only two steps in a measurement cycle for the super set no matter how many reciprocal compensated difference constructs are in the super set. As such, using reciprocal constructs in a tool can allow faster measurement speed and/or lower power consumption.

Without the presence of mutual coupling the compensated differential measurement is independent of antenna total gains (sum of designed and uncontrolled gains) or efficiencies. As such, the proper conversion and interpretation of the tool's measurement does not require detailed knowledge of total antenna gains. The primary motivation for improving antenna efficiency is to increase the ratio of the field signal received by a electronics of a receiver to the noise in the electronics of the receiver. This ratio may be termed electronic signal-to-noise ratio.

In reality, mutual coupling may be non-negligible and its effect increases with antenna efficiency. The original field generated by a transmitter at a receiver location is the signal to measure. The mutual coupling field at the same location is a noise in field signal and is not a noise in electronics. As the receiver antenna efficiency increases the ratio of received field signal to electronic noise increases desirably. A mutual coupling field at the receiver location is not relatively reduced or altered by the increase in the efficiency of the receiver. On the contrary, the mutual coupling field at the receiver location generated by an antenna near the receiver or the transmitter increases with this efficiency increase of the nearby antenna. The improvement in antenna efficiency in a system of antennas reduces the effect of electronic noise and may increase the effect of mutual coupling. The mutual coupling noise increases relative to the desirable signal with the efficiency improvement of the antenna generating the mutual coupling field.

To properly account for mutual coupling effect in modeling, the total antenna gains have to be precisely known. The precise values of the total gains are very difficult to determine. Total gains depend on minute details of antenna construct and the properties of the materials used in antenna components. Total gains also vary from antenna to antenna. Total gains are strong functions of temperature. The total gains may even be non-repeatable and exhibit hysteresis over temperature cycles. So far, modeling mutual coupling effect is impossible. Mutual coupling must be directly reduced or eliminated to further increase the accuracy of measurements of a resistivity tool.

In U.S. Pat. No. 5,438,267 (hereinafter referred to as "Wu" and hereby incorporated by reference herein in its entirety), an antenna system (hereinafter referred to as "Wu94 antenna") was designed wherein the antenna mutual coupling is completely eliminated by applying on/off sequences (hereinafter referred to as "Wu sequences") to antennas. The distinct feature of a Wu sequence for a single composite measurement is that an antenna is turned on only once during the sequence. The antenna gains are removed from the composite measurement. There is no possibility of measurement error due to hysteresis in antenna gains. The patent is herein incorporated into this invention by reference, and in particular, the Wu sequences. However, the design is effective only for antenna systems without highly permeable ferrite material. When ferrites are used, an antenna cannot be turned off by the antenna wire opening technique used in Wu.

In U.S. Pat. No. 5,138,263 (hereinafter referred to as "Towle" and hereby incorporated by reference herein in its entirety), ferrite material with high magnetic permeability and minimal hysteresis was used to increase antenna signal. In U.S. Pat. No. 5,530,358 (hereinafter referred to as "Wisler" and hereby incorporated by reference herein in its entirety), antennas are made of slots carved on the surface of antenna section of a resistivity tool's cylindrical segment. An antenna incorporating elements of techniques shown in Towle and Wisler is hereafter referred to as a "Wisler antenna" or "Wisler design". The Wisler patent is hereby incorporated by reference, and in particular, the Wisler design.

FIG. 3 is a schematic and non-proportional side view of an antenna section 1 using the design by Wisler. The antenna section 1 includes a steel housing 2. Slots 3 positioned parallel to the axis of the tool cylinder are cut and are approximately evenly distributed circumferentially. Wire holes 4 are pathways in the steel housing 2 between slots 3. Slots 3 and wire holes 4 form a circumferential pathway for antenna wire (not shown).

FIG. 4 is a cross-sectional view of the antenna section 1 in a plane that is perpendicular to the cylindrical axis of the antenna section 1 and is at the antenna wire 5 in a Wisler antenna. The antenna wire 5 in FIG. 4 is illustrated as a dashed line. Wire holes 4 are positioned at a distance away from the surface of the sub 8*a*. The highly magnetic ferrite rods 6 are positioned in the bottom sections of the slots 3 under the antenna wire 5. Non-conductive and non-magnetic material 7 is used to fill the space in the slots 3 above the antenna wire 5 for protection of the antenna wire 5 and ferrite rods 6. A wire passageway 8 provides access for the antenna wire 5 to electronic circuitry.

FIG. 5 is an expanded view illustrating the antenna wire 5 and ferrite rods 6 shown in FIG. 4. The steel structure and other components in the antenna structure are not shown in this figure. Wire segments 9 and 10 connect the antenna wire 5 to and from an electronic circuitry 11. The antenna wire 5 and wire segments 9 and 10 may be made of a single continuous wire. The wire segments 9 and 10 may be twisted.

Ferrites greatly increase antenna efficiency and power. In any antenna using ferrite material to increase antenna efficiency the main transmitting or receiving power comes from the ferrite material, not directly from the antenna wire. For example, in a Wisler transmitter antenna, the antenna wire current is used mainly to excite the ferrite rods which in turn generate (transmit) electromagnetic field. The electromagnetic field generated directly from the wire current is much smaller than that of the ferrite rods. In a receiver, the wire current is mainly induced by electromagnetic field inside receiver ferrites. The field inside receiver ferrites is excited by the original field to be measured at the receiver location. Only a small part of the receiver current comes directly from the original field to be measured.

When ferrites are used for antennas, an antenna cannot be turned off by greatly increasing the impedance of the antenna wire. The excited ferrites in a receiver still generate field at nearby locations even if the receiver wire is open and there is no current in it. The mutual coupling to a nearby receiver is largely intact. Similarly, the mutual coupling between a pair of closely spaced transmitters using ferrites is not significantly reduced by opening the antenna wire of one transmitter while the other transmitter is transmitting. The ferrites in the designated non-transmitting antenna are excited by electromagnetic field generated from the nearby transmitting antenna. In turn, the excited ferrites in the designated non-transmitting transmitter generate electromagnetic field at receiver locations. By merely opening the antenna wire it is impossible to turn off a transmitter with ferrites if a nearby transmitter is transmitting. The reciprocity principle dictates that a transmitter can be a receiver with the same efficiency and vice versa. The antenna generating a mutual coupling field can't be turned off if ferrite material is employed regardless whether the antenna is used as a transmitter or receiver. As such, when two antennas are close to each other the potential mutual coupling cannot be eliminated using any and all prior art techniques.

A LWD wave propagation resistivity tool provides multiple composite measurements. Each composite measurement is made with a set of antennas. Some sets overlap in antennas to minimize tool cost and to achieve common measurement point. Usually, multiple frequencies are used by a tool. When ferrite material is used in antennas to increase their sensitivities (powers or designed gains, or efficiencies) an antenna cannot be turned off and is a source for mutual coupling to a nearby antenna in prior art tools. Mutual coupling exists between a pair of closely-spaced antennas using ferrites regardless whether either antenna is used as a transmitter or a receiver. Ferrite material used in the industry maintains high magnetic permeability over the range of frequencies used by LWD tools. An antenna designed to transmit or receive at a first frequency still can be excited by an electromagnetic field at a second frequency and can mutually couple with a close-by antenna of the second frequency. Namely, even though the antenna wires in a pair of close-by antennas using ferrite material are tuned at different frequencies, the antennas still mutually couple through ferrite materials used within. A Wisler antenna cannot be turned off or switched off for the purpose of eliminating mutual coupling.

In general, the benefit of using ferrite material to greatly increase efficiency of an antenna outweighs the short comings of increased mutual coupling effect between close-by antennas. Overall signal to noise ratio is increased. However, the error associated with mutual coupling is still larger than accuracy requirement for many LWD wave propagation resistivity tools.

In the industry, the common practice of accounting for receiver mutual coupling is to perform a calibration of tool measurements in air. A resistivity tool is hung in air, away from the Earth ground and adjacent metal objects. The receiver readings in this setup are recorded into the tool. In measurement mode, the air-hanging phase difference in degrees and amplitude ratio in dBs are subtracted from the corresponding receiver readings. The resulting receiver readings are relative to those of air hanging and are raw tool measurements (outputs). The raw measurements are used for resistivity conversions and data interpretations. Conversion functions obtained from model computations are constructed in the exact same manner. Modeled air-hanging values are subtracted from modeled receiver readings in modeled formations and the results are compared with tool outputs. In earlier resistivity tools, compensation was not used. Air-hanging calibration was mainly used to remove the effect of antenna gain imbalance in the two receivers on differential measurements of a tool. In tools utilizing compensated differential measurements, the air-hanging calibration is mainly used to eliminate the effect of mutual coupling between closely-spaced antennas.

In using the air-hanging calibration procedure for removing mutual coupling effect, there is an assumption the mutual coupling effects on receiver measurements are constants in phase difference and amplitude ratio regardless of the difference in between unperturbed electromagnetic field values at the two receiver locations. This assumption is inaccurate.

Unlike the effect of antenna gains on receiver measurements, mutual coupling between a pair of closely spaced antennas does not simply rescale by a constant the original electromagnetic field signals unperturbed by the presence of either of the two antennas. The mutual coupling signal is added to the electromagnetic field signal. For a particular measurement the total field can be forcefully formulated as the original field scaled by a complex factor. The factor, however, is not a constant and varies with the original field. Mutual coupling does not simply cause the reading of a receiver to be the original electromagnetic field signal shifted in phase by a constant and rescaled in amplitude by a constant. The air-hanging calibration only calibrates a tool's measurement at the single point when the tool is in air and is away from conductive material. In other environments, a tool measurement's phase shift and amplitude ratio changes due to mutual coupling are not the same as those of the tool being in air.

The magnitude of mutual coupling is a function of antenna efficiency or total gain. The amplitude ratio of a mutual coupling field over the original field at a receiver location is proportional to the efficiency of the nearby antenna generating the mutual coupling field. The less efficient the nearby antenna is, the smaller the mutual coupling field relative to the original field. Antenna efficiency may change with temperature. The air-hanging calibration only calibrates the tool measurements at a single temperature. Temperature of the tool during operations may be and usually is significantly different from that of air hanging. The mutual coupling effect on measurements of a tool during operations may be significantly different from that of air hanging due to temperature difference.

The subtraction of air hanging values from measurements during operations may not completely remove the mutual coupling effect due to mutual coupling being sensitive to temperature of a tool and the environment a tool is in.

The air-hanging operation also is a non-trivial undertaking. A tool is generally hung tens of feet above the ground and tens of feet away from sizable metal structures. The calibration cannot be done inside most laboratories in industrial buildings or on most drilling rig sites.

SUMMARY OF THE INVENTION

In some embodiments, a magnetic core forms a continuous loop around an opening. For example, the magnetic core may be shaped like an extremely elongated toroid or rectangular cuboid with a hole (i.e., opening). The magnetic material may have a high magnetic permeability (μr value). In some embodiments, the magnetic core includes a first axis and a second axis. The first axis (i.e., long axis) having a value greater than the second axis (i.e., short axis). The hole in the magnetic core is positioned in the middle along the long axis. A winding wire is wound multiple times on the magnetic core. When current (i.e., an appropriate direct current (DC) or a combined direct current and alternating current signal in which the direct current component is above a minimum saturation level of the magnetic core), is applied to the winding wire the lines of magnetic field flux from the current loop through the magnetic core. The effective magnetic permeability of the magnetic material can be reduced to that of air if the magnetic field generated by the current is strong enough (i.e., strong DC current and/or AC current) to cause and maintain saturation of the magnetic core for a period of time to disable the antenna. The magnetic cores are placed in slots (e.g., Wisler design). An antenna is disabled by the application of current in the winding wire and is enabled when the current is turned off. The current causes a magnetic saturation of the magnetic core. An on/off sequence is used in the operation of the antennas. The mutual coupling is completely eliminated. In a steerable magnetic dipole antenna using magnetic cores one can steer the direction of a dipole by magnetically saturating certain group of magnetic cores by the current in the windings in the magnetic cores.

BRIEF DESCRIPTION OF DRAWINGS

Like reference numerals in the figures represent and refer to the same or similar element or function. Embodiments of the present disclosure may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

For antenna efficiency and linearity magnetic cores used for wave propagation resistivity antennas are made of high magnetic permeability material with minimum magnetic hysteresis such as a group of ceramic materials known as "ferrite." Like most magnetic material the ferrite can lose its magnetic permeability under strong magnetic field. This is called magnetic saturation. The minimum value of the field for causing saturation may be called a saturation field. If a DC field is strong enough, then the magnetic permeability of a ferrite for an AC field superposed on the DC field can be reduced to that of air provided that the total field is never smaller than the saturation field. The relative magnetic permeability for the AC field becomes one.

Figure 1:
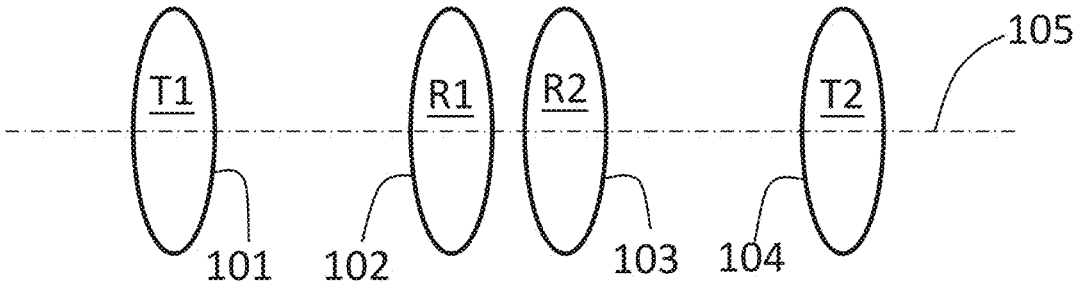
FIG. 1 (Prior Art)
FIG. 1 is a schematic view of several prior art antennas with transmitters in the middle.
Figure 2:
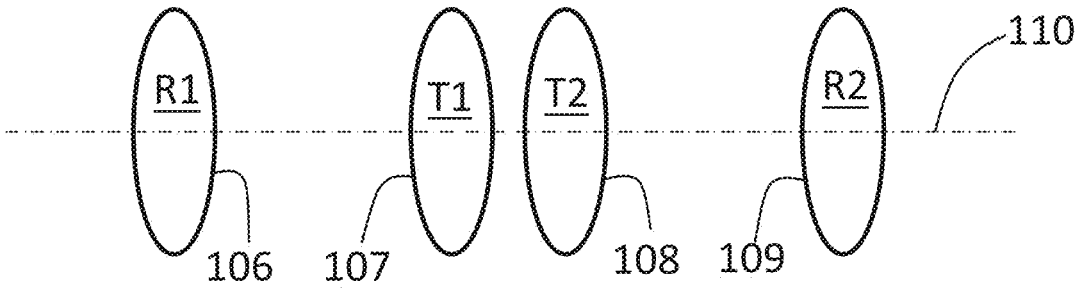
FIG. 2 (Prior Art)
FIG. 2 is a schematic view of several prior art antennas with receivers in the middle.
Figure 3:
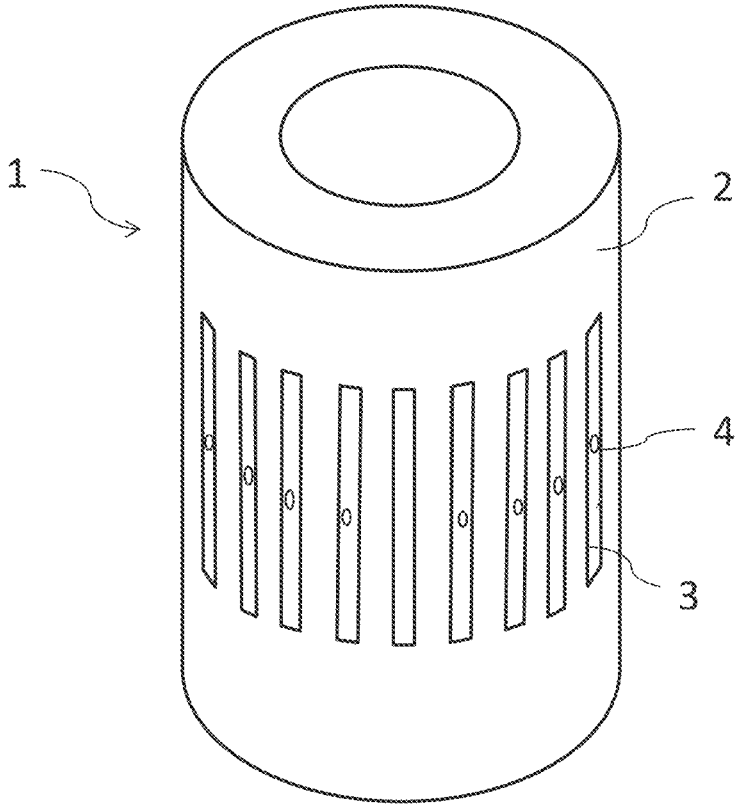
FIG. 3 (Prior Art)
FIG. 3 is a schematic and non-proportional side view of an antenna section in a prior art design by Wisler et al.
Figure 4:
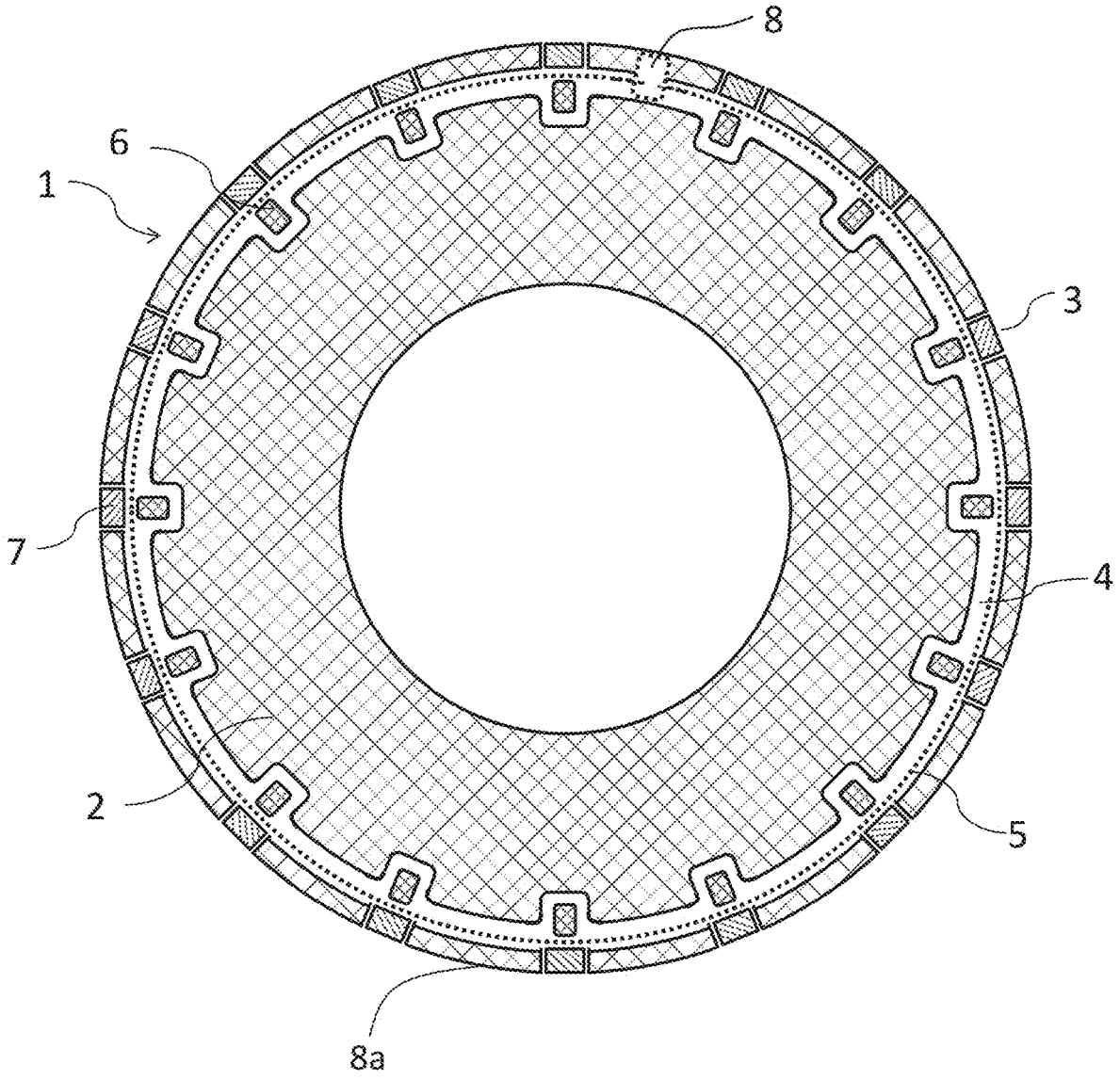
FIG. 4 (Prior Art)
FIG. 4 is a cross-sectional view of the antenna structure at the antenna section shown in FIG. 3.

In a wave propagation resistivity tool using ferrite in antennas, ferrite rods are placed in slot structures on the surface of a cylindrical steel sub. In a Wisler antenna, as shown in FIG. 4, the antenna wire 5 passes over the ferrite rods 6 between the rods and the non-magnetic material 7 in the slot 3. The current in the antenna wire excites the ferrite rod in a transmitter. In an improved design of the Wisler antenna shown in U.S. Pat. Nos. 11,616,284 and 11,682,821 (hereinafter referred to as "Wu ferrite rod antennas", the antenna wire passes in one direction over and in the opposite direction under a ferrite rod, the net current in the antenna wire forms a closed loop around the ferrite rod. The current loop excites the ferrite rod in a transmitter. Because of the limited power supply in a wave propagation resistivity tool and how the antenna current passes around a ferrite rod the magnetic field experienced by ferrite rods in a transmitter are far less than the saturation field. The magnetic field at a receiver is smaller than that of a transmitter. As such ferrite rods in active antennas never encounter magnetic saturation during the normal operation of a wave propagation resistivity tool.

In antennas using ferrite rods such as the Wisler antennas and the Wu ferrite rod antennas, the main antenna power comes from the ferrite rod, not from the antenna wire. To eliminate the mutual coupling between closely spaced antennas one antenna is disabled while the alternate antenna is on. Antennas using ferrite as the main transmitting or receiving component can only be disabled by reducing the relative magnetic permeability of the ferrite rods down to a value close to one for the operating frequency.

Before explaining at least one embodiment of the present disclosure in detail, it is to be understood that embodiments of the present disclosure are not limited in their application to the details of construction and the arrangement of the components or steps or methodologies set forth in the following description or illustrated in the drawings. The inventive concepts in the present disclosure are capable of other embodiments or of being practiced or carried out in various ways. Also, it is to be understood that the phraseology and terminology employed herein is for the purpose of description and should not be regarded as limiting.

In this detailed description of embodiments of the inventive concepts, numerous specific details are set forth in order to provide a more thorough understanding of the inventive concepts. However, it will be apparent to one of ordinary skill in the art that the inventive concepts disclosed and claimed herein may be practiced without these specific details. In other instances, well-known features have not been described in detail to avoid unnecessarily complicating the instant disclosure.

As used herein, language such as "including," "comprising," "having," "containing," or "involving," and variations thereof, is intended to be broad and encompass the subject matter listed thereafter, equivalents, and additional subject matter not recited or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Throughout this disclosure and the claims, the terms "about," "approximately," and "substantially" are intended to signify that the item being qualified is not limited to the exact value specified, but includes slight variations or deviations therefrom, caused by measuring error, manufacturing tolerances, stress exerted on various parts, wear and tear, or combinations thereof, for example.

The use of the term "at least one" will be understood to include one and any quantity more than one. The term "at least one" may extend up to 100 or 1000 or more, depending on the term to which it is attached; in addition, the quantities of 100/1000 are not to be considered limiting, as higher limits may also produce satisfactory results. Singular terms shall include pluralities and plural terms shall include the singular unless indicated otherwise.

"A measurement" or "a measurement point" may include a set of parameters. In particular a phase parameter and an amplitude parameter of an electromagnetic field maybe individually or jointly termed as "a measurement". Either the parameters of a composite measurements or the process of measurement steps or measurement sequences may be referred to as a measurement or measurements. A parameter derived from a measurement or measurements may also be termed a measurement.

The term "or combinations thereof" as used herein refers to all permutations and/or combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

As used herein any reference to "one embodiment" or "an embodiment" means that a particular element, feature, structure, or characteristic described in the embodiment is included in at least one embodiment. The appearances of the phrase "in one embodiment" in various places in the specification are not necessarily referring to the same embodiment, although the inventive concepts disclosed herein are intended to encompass all combinations and permutations including one or more features of the embodiments described.

As used herein, all numerical values or ranges include fractions of the values and integers within such ranges and fractions of the integers within such ranges unless the context clearly indicates otherwise. Thus, to illustrate, reference to a numerical range, such as 1-10 includes 1, 2, 3, 4, 5, 6, 7, 8, 9, 10, as well as 1.1, 1.2, 1.3, 1.4, 1.5, etc., and so forth. Reference to a range of 1-50 therefore includes 1, 2, 3, 4, 5, 6, 7, 8, 9, 10, 11, 12, 13, 14, 15, 16, 17, 18, 19, 20, etc., up to and including 50, as well as 1.1, 1.2, 1.3, 1.4, 1.5, etc., 2.1, 2.2, 2.3, 2.4, 2.5, etc., and so forth, as well as sub ranges within the overall range such as 2-45, 1-10, 20-40. Reference to a series of ranges includes ranges which combine the values of the boundaries of different ranges within the series. Thus, to illustrate reference to a series of ranges, for example, of 1-10, 10-20, 20-30, 30-40, 40-50, 50-60, 60-75, 75-100, 100-150, 150-200, 200-250, 250-300, 300-400, 400-500, 500-750, 750-1,000, includes ranges of 1-20, 10-50, 50-100, 100-500, and 500-1,000, for example.

Circuit or circuitry, as used herein, may be analog components and/or digital components, or one or more suitably programmed processors (e.g., microprocessors) and associated hardware and software, or hardwired logic. Additionally, "components" may perform one or more functions, or may contribute to performance of one or more functions. As used herein, the term "processing component," may include hardware such as a processor, a microprocessor, a mobile processor, a system on a chip (SoC), a central processing unit (CPU), a microcontroller (MCU), a digital signal processor (DSP), an application specific integrated circuit (ASIC), a field programmable gate array (FPGA), a Tensor Processing Unit (TPU), a graphics processing unit (GPU), a combination of hardware and software, software, and/or the like. The term "processor" as used herein means a single processing component or multiple processing components working independently or together to collectively perform a task.

Software may include one or more processor-executable instruction that when executed by one or more processing component, e.g., a processor, causes the processing component to perform a specified function. It should be understood that the algorithms described herein may be stored on one or more non-transitory processor-readable medium. Exemplary non-transitory processor-readable media operable to store processor-executable instructions may include a non-volatile memory, a random access memory (RAM), a read only memory (ROM), a CD-ROM, a hard drive, a solid-state drive, a flash drive, a memory card, a DVD-ROM, a Blu-ray Disk, a laser disk, a magnetic disk, an optical drive, combinations thereof, and/or the like. Such non-transitory computer-readable media may be electrically based, optically based, magnetically based, resistive based, and/or the like.

Further, the messages described herein may be generated by the components and result in various physical transformations.

Figure 7:
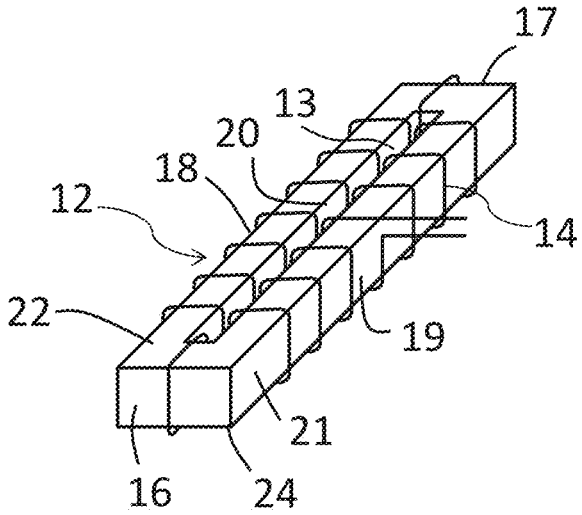
FIG. 7 is a schematic side view of a magnetic core with electric wire winding constructed in accordance with the present disclosure.

FIG. 7 schematically depicts a magnetic core 12 that is configured to be turned on or off in accordance with the present disclosure. In some embodiments, some magnetic cores 12 are configured to be turned on (having high magnetic permeability, i.e., within a range of 10-25000) or off (having low magnetic permeability, i.e., within a range from 0-2). Generally, application of current (e.g., DC current or a combination of DC and AC current) causes magnetic saturation of the magnetic core during a period of time in which the DC current or DC current and AC current is applied. An on/off sequence of current is used to operate an antenna having a plurality of magnetic cores 12.

The magnetic core 12 has an elongated hole 13 in the middle (e.g., central opening) such that the magnetic core 12 forms a continuous loop around the elongated hole 13. The magnetic material of the magnetic core may be any magnetic material having a relative magnetic permeability ($\mu r$) greater than 10 and less than 25000, and more preferably between 3000-5000. An exemplary magnetic material is ferrite. Electric wire 14 (i.e., winding wire) is wound about the magnetic core 12. Hereinafter, the electric wire 14 wound about the magnetic core 12 through the elongated hole 13 may be referred to as "the winding" or "winding wire". The electric wire 14 can be made of copper, for example.

In some embodiments, the magnetic core 12 has a first end 16 and a second end 17, a first side 18, and a second side 19. The first side 18, and the second side 19 have lengths greater than lengths of the first end 16 and the second end 17. The magnetic core 12 also has an inner peripheral surface 20 surrounding the elongated hole 13, and an outer peripheral surface 21 spaced a distance from the inner peripheral surface 20. The magnetic core 12 also has a top surface 22 and a bottom surface 24. The elongated hole 13 extends from the top surface 22 to the bottom surface 24. The winding 14 is threaded through the elongated hole 13 and configured to provide a plurality of windings from the inner peripheral surface 20 to the outer peripheral surface 21 across the top surface 22 and the bottom surface 24 and along the first end 16, the second end 17, the first side 18 and the second side 19.

Figure 8:
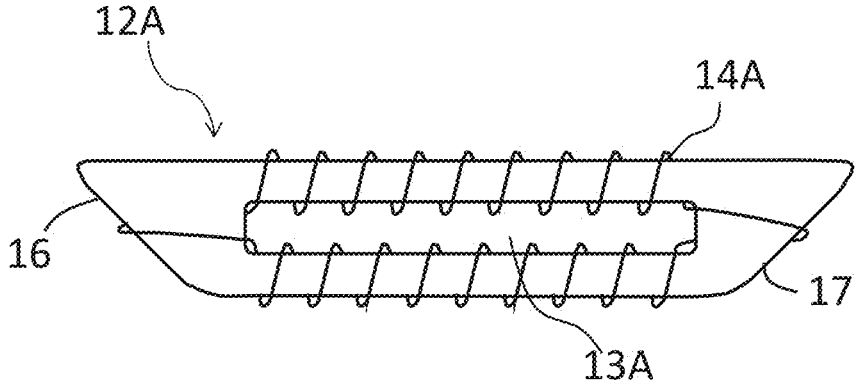
FIG. 8 is a schematic side view of another version of a magnetic core with electric wire winding with tapered ends in accordance with the present disclosure.

In some embodiments, as shown in a magnetic core 12A having a hole 13A and electric wire 14A in FIG. 8, the first end 16 and/or the second end 17 may be tapered. Although edges of the first end, the second end, the first side and the second side are shown as meeting at substantially ninety degree angles in FIG. 7, it should be noted that edges may be curved and/or meet at less than or greater than ninety degrees. Additionally, although FIG. 7 illustrates the first side and second side as congruent, the first side 18 and the second side 19 may be different shaped and/or sized. Similarly, although FIG. 7 illustrates the first end 16 and the second end 17 as congruent, the first end 16 and the second end 17 may be different shaped and/or sized. The magnetic core 12 is preferably provided with a continuous path surrounding the elongated hole 13 and the inner peripheral surface 20.

Figure 10:
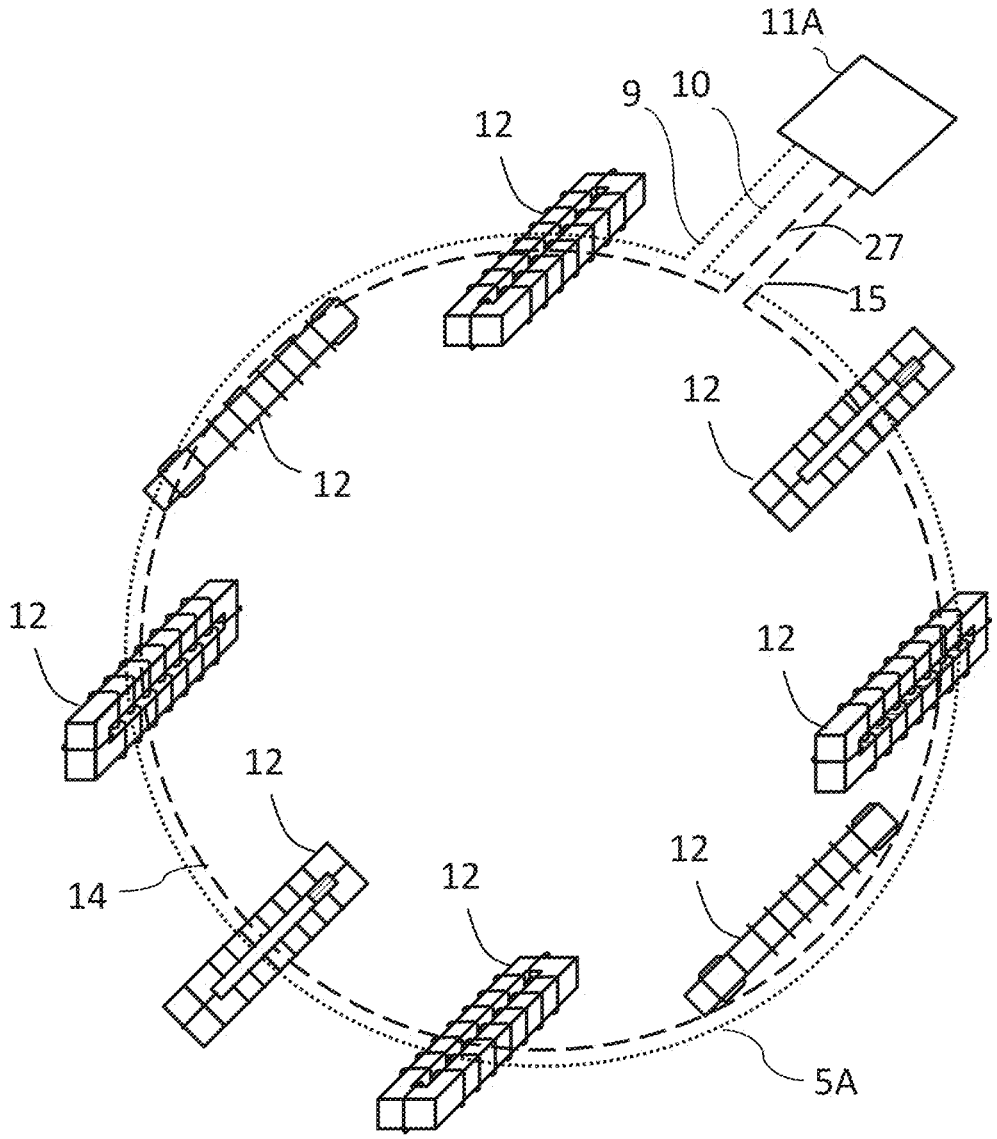
FIG. 10 is a schematic expanded view of antenna wire, magnetic cores, and a wire linking windings on all magnetic cores in accordance with the present disclosure.

As shown in FIG. 10, the winding 14 is connected to electronic circuitry 11A. The magnetic core 12 is turned on, for example, by having zero current in the winding 14. To turn the magnetic core 12 off a current (e.g., DC current/a combined DC and AC current as described above) is applied to the winding 14. The magnitude of the current in winding 14 is large enough so that the magnetic core 12 is magnetically saturated. For example, a DC current may be applied at an amount configured to saturate the magnetic core 12. In some embodiments, a combined DC and AC current may be applied such that the amplitude of the DC current is configured to saturate the magnetic core 12. The current may be called saturating current. The magnetic core 12 becomes ineffective magnetically and turned off. In some embodiments, the winding 14 may be connected to the electronic circuitry 11A via a piece of coaxial cable or twisted pair so that there is minimum magnetic field generated by the current in the connection.

The relative magnetic permeability of the magnetic material (e.g., ferrite material) used in antennas of resistivity tools can be several thousand. For the purpose of magnetically disabling the magnetic core 12 it may be unnecessary to reduce magnetic core relative magnetic permeability of the magnetic core 12 to exactly one. Often, it may only be necessary to make the relative permeability sufficiently close to one such as less than two or within a range from 0.5 to 2 or from 1 to 2 so as to magnetically disable the magnetic core 12.

The total magnetic field experienced by the magnetic core 12 is the current field plus the A/C field at tool's operating frequency. To keep the magnetic core 12 saturated the current is maintained at a level where the effective relative magnetic permeability of the magnetic material remains close to one under most or all A/C field experienced at the antenna location. The saturating current of winding 14 may include a current that makes the relative magnetic permeability of the magnetic core 12 be close to one under all possible A/C field conditions.

The magnetic material used for the magnetic core 12 may have a small hysteresis. There may be a small saturation remanence in the magnetic core 12 in a zero DC field. In prior art antennas there is no mechanism for removing the remanence in magnetic cores. A small DC current such as 0.25 Amperes or less in winding 14 may be maintained and used to remove the remanence or fine-tune the magnetic property of the magnetic core 12 to improve the performance of the magnetic core 12. Hereinafter a zero DC current (or no current) in winding 14 may also mean a small DC current.

The coercivity of the magnetic core 12 is small. The magnetic core 12 can be changed from being magnetically saturated to being highly magnetically permeable by simply turning DC current in winding 14 off or into a value sufficiently small to not magnetically saturate the magnetic core 12. The DC current can also be reduced in steps or in a process that degausses the magnetic core 12.

The saturating current in winding 14 can be in either direction. One direction of the current can be defined as being positive and the other negative. During the operation of a system of antennas, the saturation current in winding 14 may be applied multiple times during multiple time periods, respectively. For each time period, the saturation current may be unchanged in direction. It may be advantageous to apply the saturating current in a direction(s) that follows a prescribed pattern among multiple periods of time. For example, a sequence of positive-negative saturation currents may minimize magnetic hysteresis of a magnetic core.

Figure 6:
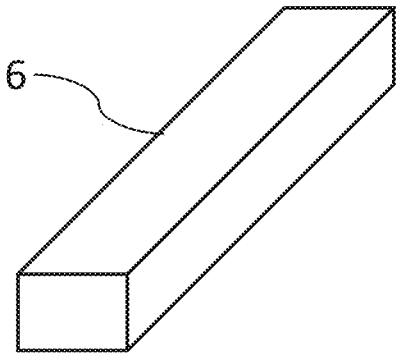
FIG. 6 (Prior Art)
FIG. 6 is a schematic view of a ferrite rod used in prior art antennas.

Both FIGS. 6 and 7 are schematic. The detailed shape of the cross sectional area of the magnetic core 12 maybe different from that shown in the figures. The cross section may be round or elliptical in shape without sharp corners. The magnetic dipole moment of the magnetic core 12 may only depends on the cross sectional area, but not on the cross sectional shape. The cross section outline may not be a constant along the major axis of the magnetic core 12. The two end sections of the magnetic core 12 may be tapered to detachably fit into the slot 3 of the Wisler antenna, for example. Such a magnetic core 12A is schematically depicted in FIG. 8 and is considered to be part of the class of magnetic cores 12 represented by FIG. 7.

Figure 9:
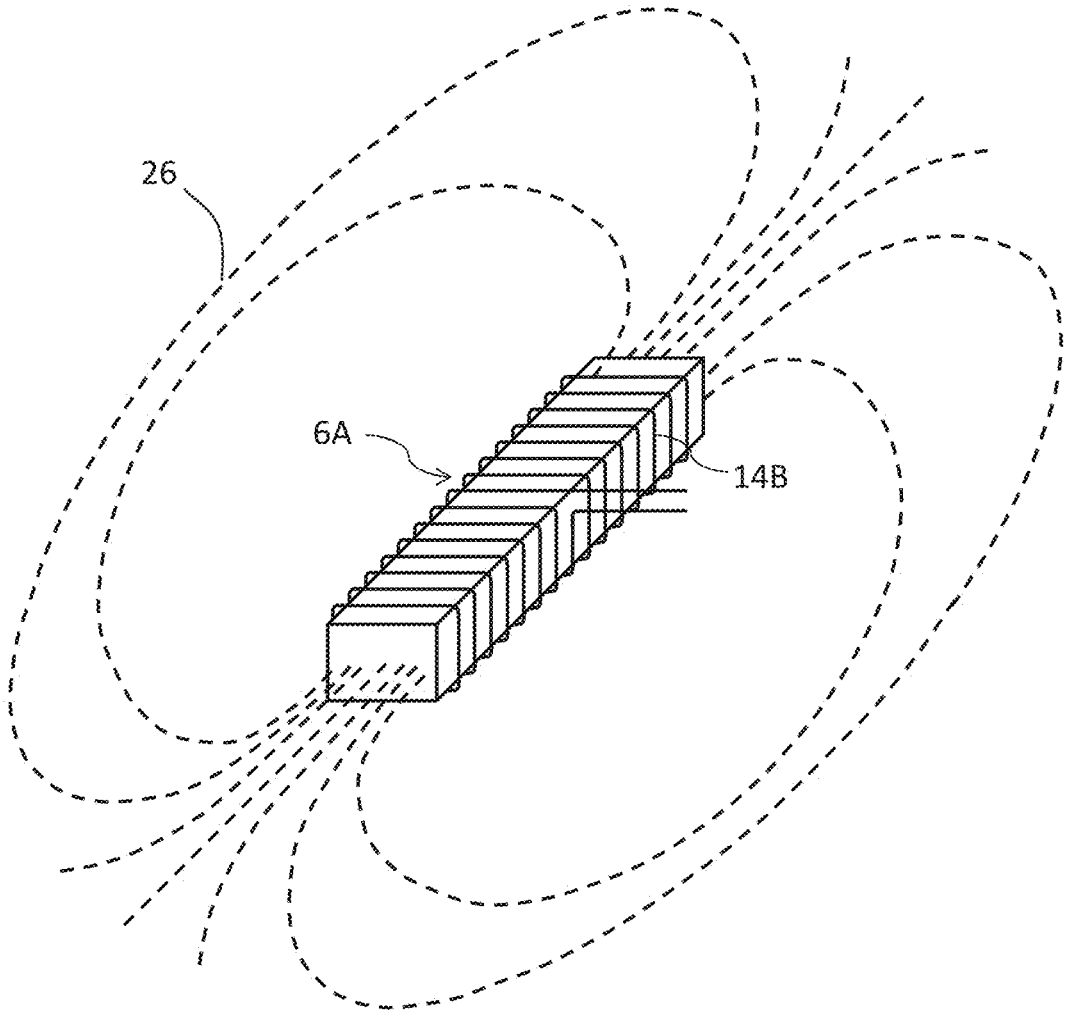
FIG. 9 is a schematic view of a solid ferrite with electric wire winding.

It should be pointed out that it is impractical to drive the magnetic core 6 of FIG. 6 into magnetic saturation by applying a current in a winding around the long axis of the magnetic core 6. To that end, FIG. 9 is a schematic view of another embodiment wherein a magnetic core 6A including an electric wire winding 14B. Electric wire winding 14B is wound around the magnetic core 6A long axis similar to a solenoid. Magnetic induction lines 26 are shown as dashed lines and are qualitative representations of a few magnetic induction lines in a plane when a current (e.g., DC current) is applied to the winding 14B. Each of the magnetic induction lines 26 forms a complete loop because of the absence of free magnetic poles in this environment. Only a portion of the magnetic induction line 26 is shown in FIG. 9. In this configuration magnetic material and the winding 14B do not form a complete loop. The major portion of any of the magnetic induction line 26 is outside the ferrite material. The magnetic reluctance mainly comes from space outside of the magnetic core 6A. The relative magnetic permeability of the outside space is close to one. The magnitude of the current required to generate the strength of magnetic induction inside ferrite material that leads to ferrite magnetic saturation is orders of magnitude larger than that of the configuration of FIG. 7. In the arrangement shown in FIG. 7, consideration of magnetic flux leakage is unimportant with respect to designing an electronic control unit 32 (FIG. 12) configured to turn the magnetic core 12 on or off. A resistivity tool does not have access to a power source for this operation. Even if the required power is available, the heat generated from the large current in the winding elevates the temperature of the ferrites, restricting the high temperature limit of tool's operating environment.

In some embodiments, the magnetic core 6A includes a first end and a second end extending between a first side, a second side, a third side and a fourth side. In some embodiments, all opposing faces of the magnetic core 6A are congruent. Edges of each side may meet at an angle (e.g., ninety degrees). In some embodiments, edges of each side may be rounded. In some embodiments, the first end and/or the second end may be tapered. The winding 14 may be formed at the first end and extend to the second end of the magnetic core 6A such that several turns are formed about the magnetic core 6A.

For clarity, the following description related to FIGS. 10-17 uses the embodiment illustrated in FIG. 7 having winding 14 and magnetic core 12, however, embodiments illustrated in FIGS. 7, 8, 9 and variations thereof may be used in accordance with the present disclosure.

Figure 5:
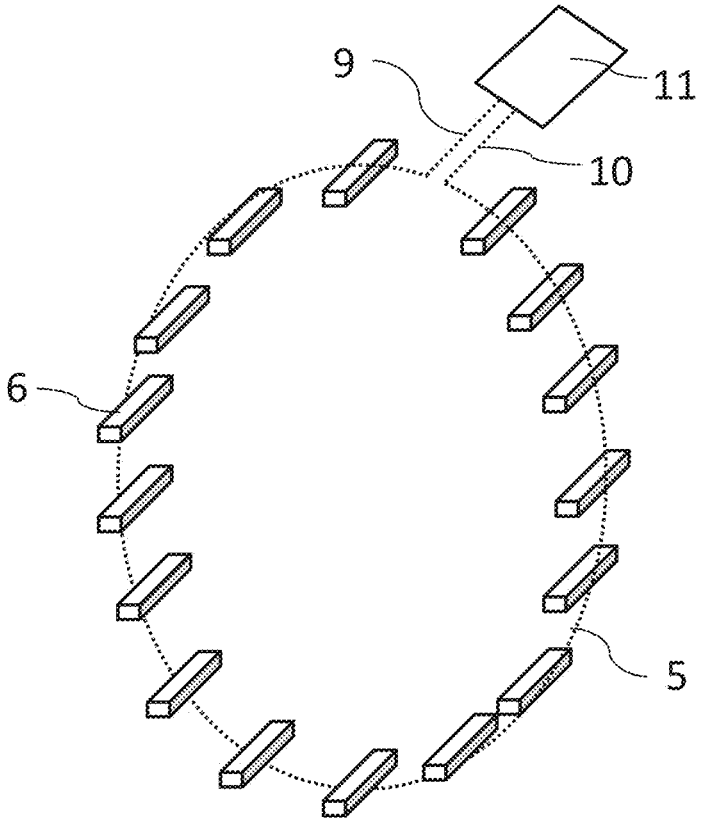
FIG. 5 (Prior Art)
FIG. 5 is a schematic expanded view of antenna wire and ferrite rods of FIG. 4.

FIG. 10 is an expanded view of antenna wire 5A and magnetic cores 12 in accordance with the present disclosure. The routes of antenna wire 5A as well as wire segments 9A and 10A are similar to FIG. 5. The positions of magnetic cores 12 are similar to magnetic cores 6 of FIG. 5. Winding 14 is connected to all the magnetic cores 12 in series and is further connected to the electronic system 11A via wire segments 15 and 27.

Figure 11:
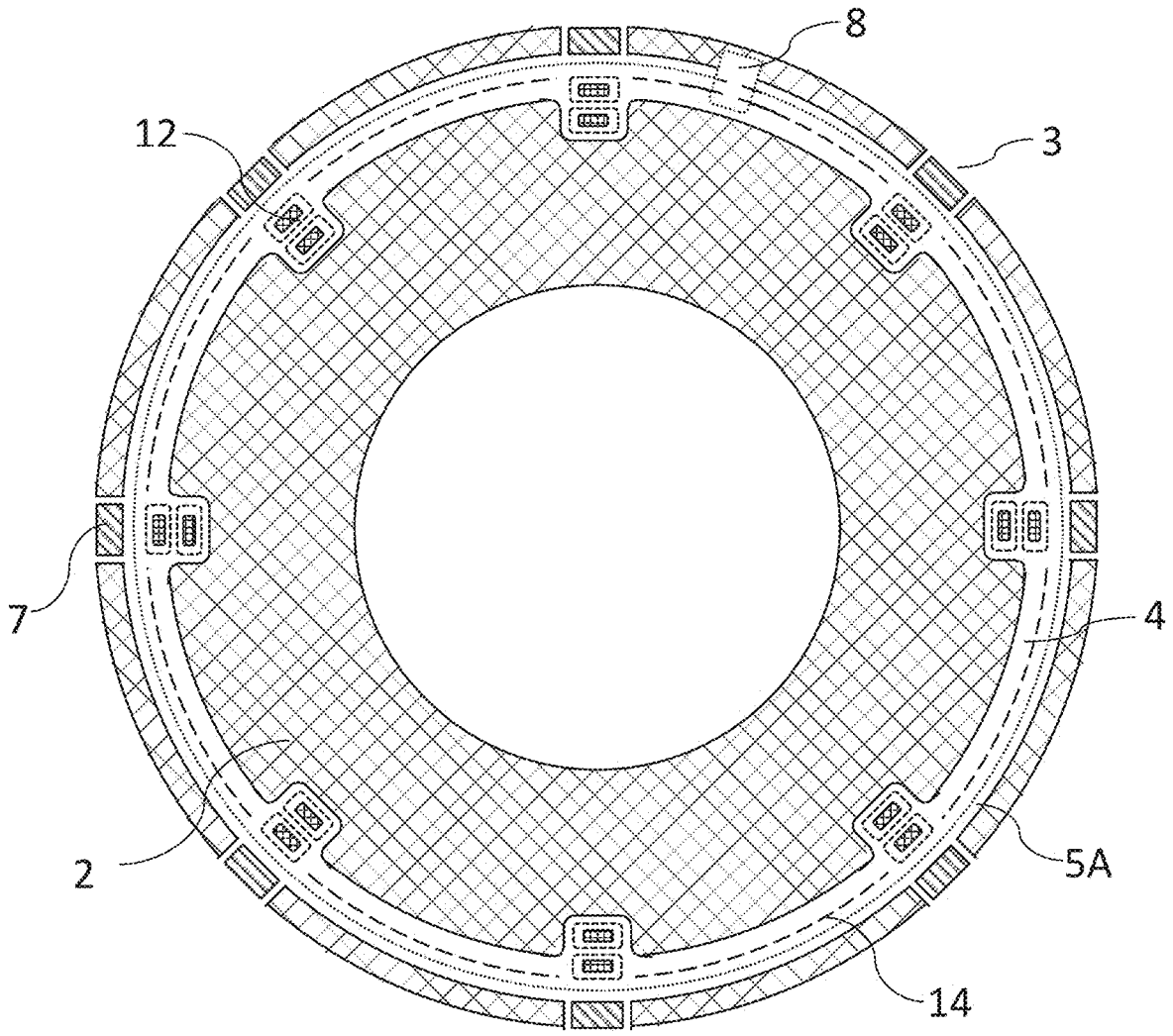
FIG. 11 is a cross-sectional view of an antenna structure at the antenna wire with a single electric winding wire for several magnetic cores.

FIG. 11 is a schematic cross-sectional view of an exemplary embodiment of an antenna section in accordance with the present disclosure. The view is in a plane that is perpendicular to the cylindrical axis of the antenna section and the plane is at the location of the antenna wire 5A. For clarity, the view of the magnetic core 12 appears as two disjoint pieces such that the hole 13 of FIG. 7 is shown as space separating the two pieces. The windings 14 around the two pieces are part of a single continuous wire winding. The winding 14 of all the magnetic cores 12 are connected together.

During the manufacturing process, winding 14 may be applied to each magnetic core 12 with a piece of wire. Then the wound magnetic cores 12 are placed in the slots 3 as shown in FIG. 11. Finally, a piece of wire is placed in a portion of the wire hole 4 between two slots 3 and is used to electrically connect one end of windings 14 of the magnetic core 12 in one slot 3 to that of an adjacent slot 3 (the one slot 3 and the adjacent slot 3 being referred to herein as "adjacent slots"). Electrically, the winding 14 of all magnetic cores 12 and the wire segments in wire hole 4 connecting the windings 14 function electrically as a single continuous electrical wire.

Antennas are tuned to resonate at operating frequency of the resistivity tool. Antenna wire 5A is connected via the wire passageway 8 to tuning circuits in an electronic system. The antenna wire 5A of an active antenna has very low impedance at operating frequencies. At the peak of resonance, the impedance of antenna wire 5A is almost the resistance in the wire which is a fraction of an Ohm. In general, wire for winding 14 is much longer than antenna wire 5A in an antenna. The resistive impedance of winding 14 is much higher than that of antenna wire 5A. More importantly, winding 14 is not tuned and has high inductive impedance at the operating frequencies. Relative to antenna wire 5A the impedance of winding 14 system at tool's operating frequencies appears to be that of an open circuit. An electromagnetic field may induce a voltage in winding 14. There is no significant current. The induced current in winding wire 14 is orders of magnitude smaller than that of antenna wire 5A. There is no measurable mutual coupling between winding 14 and antenna wire 5A. The transmitting or receiving function of the antenna wire 5A may be unaffected by the presence of winding wire 14 when there is no or a small current in the winding wire 14.

The resonance tuning of antenna wire 5A is unaffected by the winding wire 14 if the numbers of turns of winding on the two long edges of the magnetic core 12 of FIG. 7 are equal. With equal number of turns the net inductance due to winding 14 for magnetic field in the direction of the long axis of the magnetic core 12 is zero. The numbers of turns can be chosen to be uneven on purpose to alter the total inductance of a transformer-like magnetic core.

To turn on an antenna the current in the winding wire 14 is set below a saturating value, such as zero amperes. When the current is set below the saturating current, the antenna operates as an antenna in prior art. To turn off an antenna a strong current (e.g., DC current and/or AC current) is passed through the winding 14 at a value sufficient to saturate the magnetic core 12. In this instance, the winding current on each magnetic core 12 generates a magnetic field equal to or stronger than the saturation field. The relative magnetic permeability of the magnetic core 12, e.g., ferrite, is reduced to being close to one. The antenna loses its main functioning component. Since the resonance tuning of an antenna is performed when the ferrites are of high magnetic permeability (e.g., between 10 and 25000) the antenna wire 5A also becomes severely off-tuned. The induced current in antenna wire 5A of a turned off antenna is negligible compared with a possible signal in the same antenna when it is turned on. The electromagnetic field generated by a turned off antenna of the present disclosure at a nearby antenna is negligible compared with the field from a transmitter and formations. A turned off antenna of in accordance with the present disclosure does not mutually couple with a nearby antenna. Hereinafter, an antenna with a Wisler antenna structure and the magnetic cores 12 in accordance with the present disclosure will be referred to as a switchable antenna. None of the prior art antennas with ferrite material used in resistivity tools is switchable. Furthermore, turning on or switching on a switchable antenna means that the current on the windings on the magnetic cores 12 of the antenna is zero or near zero. Turning off or switching off a switchable antenna means that a saturating current (AC or DC) is applied on the windings on the transformer-like magnetic cores 12 of the antenna. In addition, a transformer-like magnetic core 12 maybe referred to as a switchable magnetic core.

The magnetic material (e.g., ferrite rods) used for magnetic cores 12 are carefully chosen to have high magnetic permeability, low loss, and minimum hysteresis. There may be some small hysteresis that causes the effective magnetic permeability at operating frequencies of the tool to be varying from turn-on and turn-off cycles. Besides the ferrite material, antenna electronics may exhibit some hysteresis. The designed antenna gain may change by a small amount after an off-on cycle.

The compensated differential measurements from a four-antenna system such as a CDC completely remove the imbalance in antenna gains between a pair of receivers provided that the receiver gains do not change during the two transmitter alternating cycle. In some embodiments of the current disclosure, the desirable property of receiver gain imbalance removal is completely preserved. Using the Wu Sequence a receiver is turned on only once during the process of a compensated differential measurement for a single measurement point. As such any hysteresis in on-off cycles in receiver antenna gains does not affect any compensated differential measurement.

In a reciprocal compensated difference construct the two transmitters are located close to each other. During operations the transmitters are energized one at a time and the two receivers are on all the time. The measurement cycle consists of two steps. As mentioned earlier mutual coupling between the transmitters may take place in prior art systems. In an embodiment of the current disclosure, the two transmitters include switchable antennas. No DC current is applied to the windings 14 of the transmitter being purposely energized. The energized transmitter functions as an efficient Wisler antenna. In the meantime, a DC current may be applied to the windings 14 on magnetic cores 12 in the off-transmitter. The DC current is set to be high enough to saturate the magnetic cores 12 of the off-transmitter. The relative magnetic permeability of a saturated magnetic core is near one for the AC field generated by the on-transmitter. The off-transmitter becomes extremely insensitive (inefficient) which is impossible to achieve for a prior art Wisler antenna where the main antenna sensitivity (power or efficiency) comes from magnetic cores. In some embodiments, the number of steps in a measurement cycle is two. Each of the four antennas in a reciprocal compensated difference construct are turned on only once in a measurement cycle. As such compensated measurement is free of effect due to hysteresis of antenna gains. The two-step cycle of a reciprocal compensated difference construct hereinafter may also be referred to as a Wu sequence.

Figure 12:
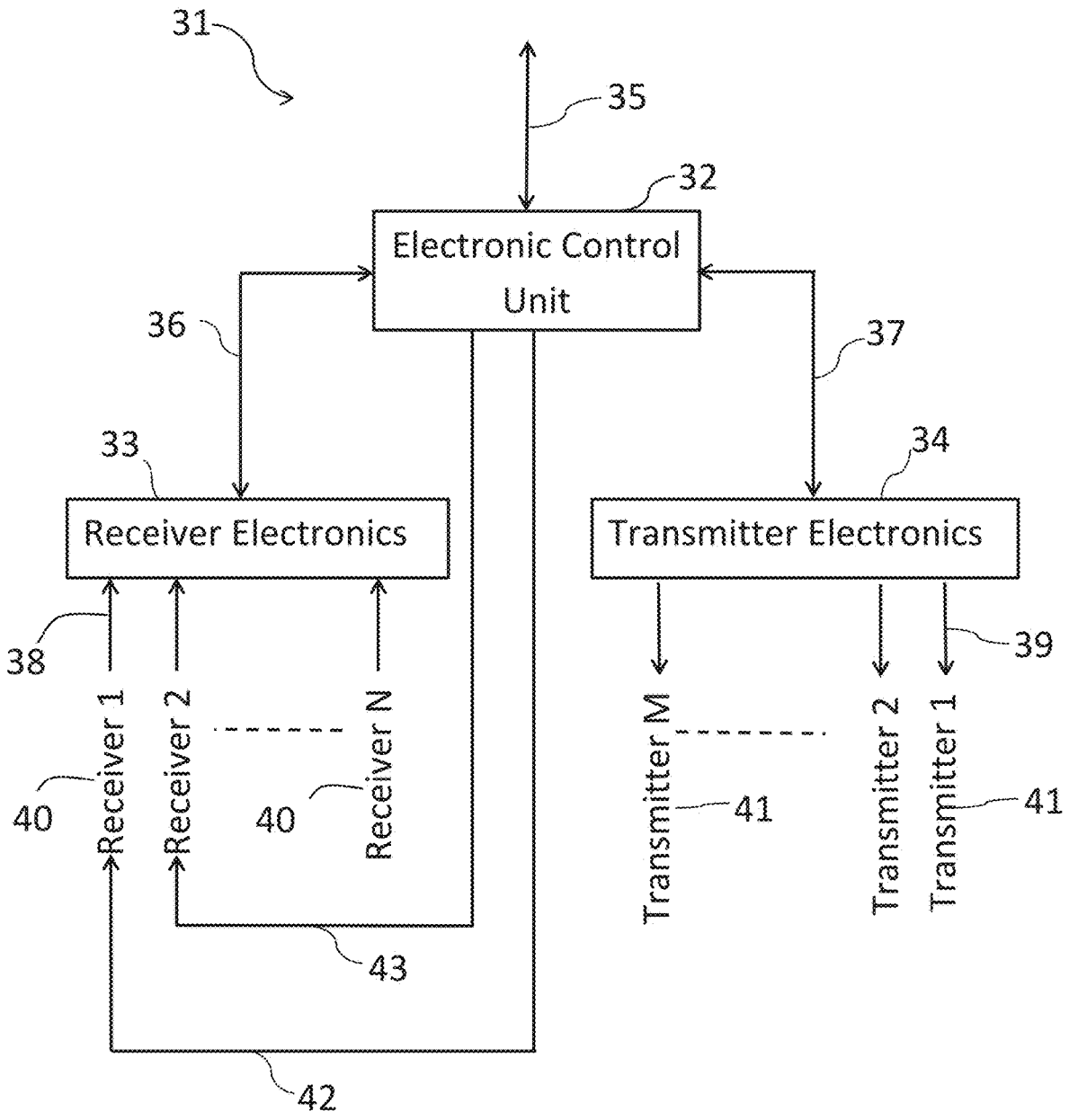
FIG. 12 is a schematic functional diagram of a transceiver system constructed in accordance with the present disclosure.

Referring to FIG. 12., the operation of a resistivity tool where two switchable receivers are part of a compensated difference construct is managed by a transceiver electronic system 31. The transceiver electronic system 31 may be housed in drill collar segment(s) of a tool, for example. The transceiver electronic system 31 may include an electronic control unit 32, a receiver electronic unit 33, and a transmitter electronic unit 34. The electronic control unit 32, the receiver electronic unit 33 and the transmitter electronic unit 34 can be constructed of circuitry. Antenna tuning and signal measurement electronics of receivers are part of the receiver electronic unit 33. Receiver antennas 40 are connected to the receiver electronic unit 33 by electric wires 38.

The electronic control unit 32 powers, controls, and collects receiver measurements from the receiver electronic unit 33 via an electric connection system 36. The electronic control unit 32 powers and commands the transmitter electronic unit 34 by a connection system 37. The transmitter electronic unit 34 comprises tuning circuits 112 and other transmitter electronics. The transmitter electronic unit 34 powers transmitter antennas 41 by a connection system 39.

During the process of a compensated difference measurement the receiver antenna 40 denoted "Receiver1" in FIG. 12 may be turned off (disabled) in accordance to Wu sequence by a current (e.g., DC current) applied to the windings 14 of magnetic cores 12 via wire 42. The current is high enough (saturating current) to drive the magnetic core 12 into magnetic saturation. Similarly, a saturating current may be applied via wire 43 to the windings 14 of magnetic cores 12 in the receiver antenna 40 denoted as "Receiver2" in FIG. 12 to turn off the receiver antenna 40 denoted as "Receiver2" during a compensated difference measurement sequence.

FIG. 12 is a schematic functional diagram of a transceiver system 31. FIG. 12 may not show the physical grouping of the subsystems. In some embodiments, part of or the electronic control unit 32 and the receiver electronic unit 33 may be fabricated on a single electronic board. Part of transmitter electronic unit 34 may be on an electronic board where majority of the electronics for the electronic control unit 32 reside. In some embodiments, antenna tuning circuits 112 of the receiver electronic unit 33 or transmitter electronic unit 34 are located next to the antennas 40 or 41 and are not on the electronic board for the rest of the unit which they are part of. The electronic control unit 32 contains a subsystem for voltage and current generation and application. The whole or part of the subsystem may be physically located next to or embedded on the receiver electronics board or the transmitter electronics board, not being next to the rest of the electronic control unit 32.

In addition to managing the sequence of antenna operations for obtaining compensated measurements during one time period, the electronic control unit 32 may also be operable for scheduling and making repeated measurements over time.

In some embodiments, using antennas arranged in a reciprocal compensated difference construct the schematic functional diagram of the transceiver system 31 are similar to what is shown in FIG. 12 except that saturating currents are applied according to Wu sequence to the windings 14 of magnetic cores 12 (i.e., transformer-like magnetic cores) in switchable transmitters which are in the reciprocal compensated difference construct.

Many design considerations and limitations require an antenna construct with one transmitter and two closely-spaced receivers to provide differential measurements without compensation. In prior art tools with such antenna construct, the mutual coupling between the two receivers is a source of measurement error. In some embodiments, the receivers are switchable and are turned on one at a time. Each measurement cycle consists of two steps. During each step one receiver is on when no current is applied to the windings 14 of the magnetic cores 12 in the one receiver's antenna. The other receiver is turned off by applying a saturating current to the windings 14 of the transformer-like magnetic cores 12 of the other receiver's antenna. The measurements in the two steps are combined to produce a differential measurement. This differential measurement is free of the effect of mutual coupling between the receivers.

In some embodiments, one receiver and two closely spaced switchable transmitters may be used to provide a differential measurement free of the effects of mutual coupling between the two transmitters. During one step in a two-step process one transmitter is transmitting while the other transmitter is idling. The transmitting antenna is enabled by not applying any current to the windings 14 on magnetic cores 12 in the transmitter. The idling transmitter is turned off (disabled) by a saturating current applied to the windings 14 on the magnetic cores 12 in the antenna. The receiver is on all the time during the two-step process.

On a LWD resistivity tool there may be multiple antennas forming multiple antenna constructs to provide multiple simple or composite measurements. Two antennas may be too close to each other for mutual coupling to be negligible. In a prior art resistivity tool, a pair of antennas belonging to two different antenna constructs may mutually couple. This may generate errors in measurements from one or both antenna constructs. In some embodiments, antennas which may mutually couple to antennas used for different composite measurements are switchable antennas. Measurement sequence is arranged such that when one of the antennas is in use either as a transmitter or as a receiver the other close-by antennas are disabled by applying a saturating current to the windings on the transformer-like magnetic cores within the antennas. The operations of different sets of antennas are coordinated to exclude mutual coupling effect on measurements.

Figure 13:
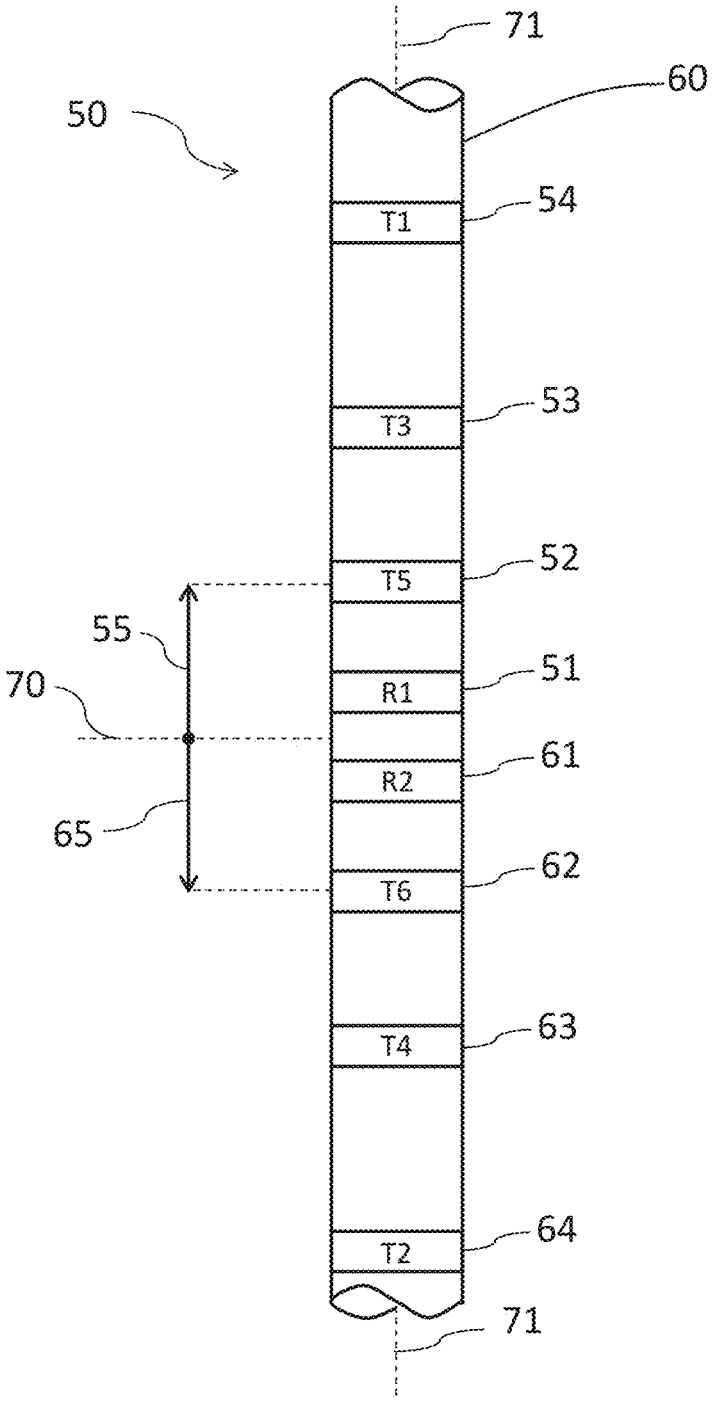
FIG. 13 is a schematic diagram of a resistivity tool with multiple pairs of transmitter antennas constructed in accordance with the present disclosure.

FIG. 13 is a schematic view of a section of a resistivity tool 50 with three sets of compensated difference measurements at each frequency. The antennas are built into a collar 60 of the resistivity tool 50. Transmitters T1, T2 and receivers R1, R2 identified at 54, 64, 51, and 52 in the figure, respectively, form a first compensated difference construct. A second compensated construct consists of transmitters T3 and T4 identified at 53 and 63, respectively, and receivers R1 and R2. Transmitters T5 and T6 identified at 52 and 62 in the figure, respectively, and receivers R1 and R2 make up a third compensated difference construct. The three constructs share a pair of receivers. The midpoint between receivers R1 and R2 indicates the axial position of the measurement point 70 for all three compensated difference measurements from the three compensated difference constructs of antennas. All three compensated measurements are sensitive to the properties of the region between the axial positions of the two receivers R1 and R2. Within this region the three measurements are sensitive to properties of three sub-regions in the radial direction from tool's axis 71. Each sub-region is characterized by its Depth of Investigation (DOI).

DOI of the measurement from a compensated difference construct is a function of the distance between the transmitters and the midpoint of the two receivers. The precise value of a DOI depends on how one mathematically defines DOI. In general, the further the transmitters are from the measurement point 70 the larger the DOI is.

In FIG. 13, T5 and T6 are closest to the measurement point 70 with distances 55 and 65, respectively. The compensated measurement made by the antenna set of [T5, T6, R1, R2] has the smallest DOI. The antenna set of [T1, T2, R1, R2] is used to obtain a measurement with the largest DOI. The tool of FIG. 13 provides three measurements with three DOIs. The shallowest measurement with antenna set of [T5, T6, R1, R2] may be used to determine the parameters of the region transitional in the radial direction between a well and its surrounding formation. The three compensated measurements are made serially in time. At any given time, antennas of only one compensated difference construct is operating. In prior art tools with transmitters axially located similarly to those of T5 and T6 the mutual coupling between the transmitters and the receivers affects the measurements using other transmitters due to T5 and T6 being too close to R1 and R2. In accordance with the present disclosure, the T5 and T6 are made of switchable antennas. When they are not transmitting, T5 and T6 are switched off. T5 and T6 of do not mutually couple to the receivers R1 and R2 when either of the two other constructs is operating. For each frequency there are three compensated measurements (three pairs of compensated phase and attenuation). The tool may operate at two or more frequencies.

In the Wu ferrite rod antennas, a steerable magnetic dipole antenna design was disclosed. Two antenna wires are used for each antenna. In a transmitter one antenna wire is used for energizing a first group of magnetic ferrites and a second group of ferrites is energized by another antenna wire. By controlling the amplitudes of and the relative phase of the two wire currents one obtains a transmitting magnetic dipole in a prescribed direction.

Figure 14:
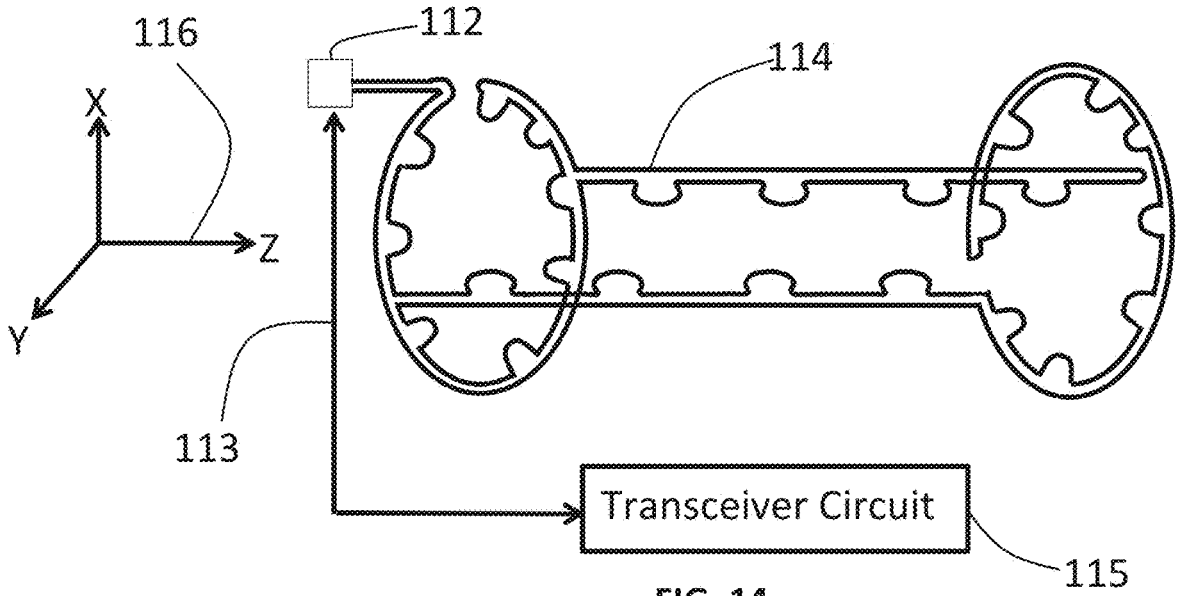
FIG. 14 is a schematic antenna wire diagram of a steerable dipole antenna with two axial sections constructed in accordance with the present disclosure.

In some embodiments in accordance with the present disclosure, a steerable antenna is energized for a transmitter or sensed for a receiver by a single antenna wire. FIG. 14 is a schematic wire diagram of an antenna on a resistivity tool. The z axis of the coordinate system 116 is the axis of the resistivity tool. The steel housing, the magnetic ferrites, and the current wire connecting ferrite windings are not shown. The single antenna wire 114 is energized or sensed just like that of a Wisler antenna. The tuning circuit 112 and the connector 113 may be constructed as in prior art systems. The part of the transceiver electronics 115 for this antenna wire may be the proven prior art type such as that of Wisler antenna. The magnetic cores 12 shown in FIG. 7 may be used. The magnetic cores 12 pointing in the axial direction of the drill string (the z-axis direction in FIG. 14) may form one or more groups (axial groups). The windings of the magnetic cores 12 in a group are in series and are connected to a single wire. The magnetic cores 12 in the group are turned off by a saturating current applied to this single wire. The magnetic cores 12 in the cross-axial direction are similarly connected and form cross-axial groups.

It is known in the art that the antenna of a wave propagation resistivity tool functions as a magnetic dipole. The antenna magnetic dipole may consist of an axial magnetic dipole component and a cross-axial magnetic dipole component. The strength of the axial magnetic dipole component is controlled by how many axial groups are turned off by a saturating current applied to the winding wire about the magnetic core. When none of the axial groups are turned off the axial magnetic dipole component is at its strongest value. When all the axial groups are turned off there is no axial magnetic dipole component. The resulting antenna may be a pure cross-axial dipole. Similarly, the strength of the cross-axial magnetic dipole component is controlled by how many cross-axial groups are turned off. With all the groups turned on the cross-axial magnetic dipole component of the antenna is at its strongest value. With all the cross-axial groups turned off the antenna magnetic dipole may be a pure axial dipole.

Various directions of the antenna dipole maybe achieved with some embodiments of the current invention. The electronics of the steerable antenna of the current invention may be simpler than that of the Wu ferrite rod antennas. The single antenna wire 114 of FIG. 14 is connected to an electronic subsystem including the tuning circuit 112 and the transceiver circuit 115. The subsystem may be identical to one used in traditional Wisler antennas. The proven prior art subsystem offers advantages in reliability and cost over the subsystem of the Wu ferrite rod antennas where two antenna wires are connected and the relative amplitude and phase between the two antenna wires must be carefully maintained and measured. The electronic component used for generating, maintaining, and correcting the two currents in the two antenna wires with precise relative amplitude and phase over operating temperature range of the antenna is precision electronics. The component is not required in a steerable antenna in accordance with the present disclosure. The electronic subsystem (part of 11A in FIG. 10) for applying saturating DC currents to windings 14 does not exist in the Wu ferrite rod antennas. This electronic subsystem, however, is not required to be precision electronics. The magnetic core 12 remains saturated once the current (e.g., DC current) is above the saturating level. The magnetic property of the magnetic core 12 does not change with the current in the winding 14 as long as the current is above the saturating value. The saturating value may change with temperature. A saturating current, e.g. a saturating DC current is therefore set at a level above the minimum value required to achieve saturation for the entire temperature range experienced by the antenna. In addition, the current level may be above the minimum by an amount larger than the possible change in itself due to possible power supply fluctuations. During antenna operations a predetermined current is either applied or not applied. No real-time precision monitoring and correction is needed. This electronic subsystem 11A is low-cost, reliable, and easy to operate.

Figure 15:
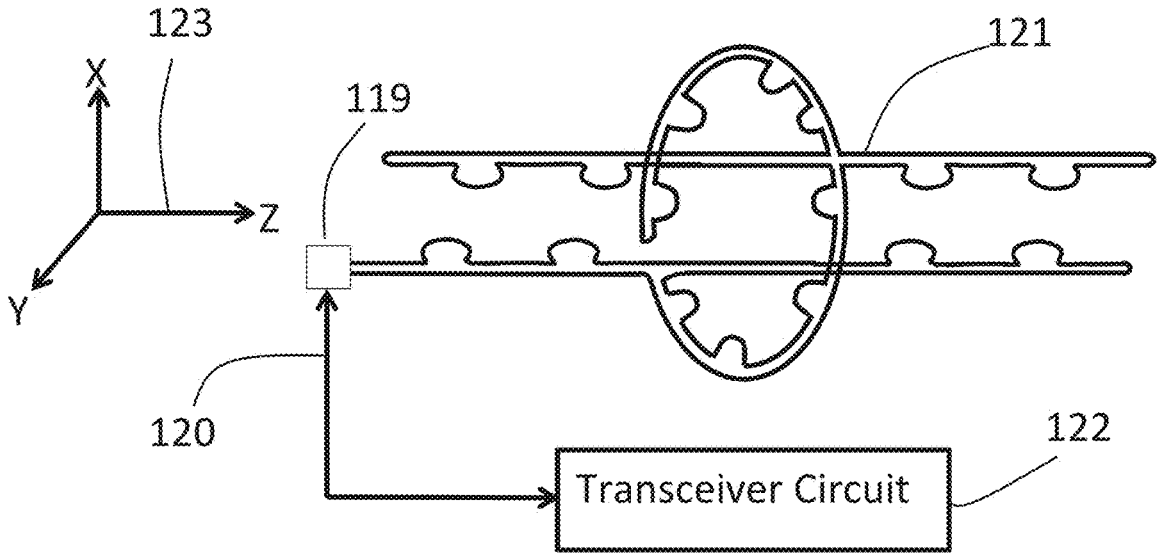
FIG. 15 is a schematic antenna wire diagram of a steerable dipole antenna with two cross-axial sections.

In the steerable antenna schematically depicted by FIG. 14, the axial positioned magnetic cores 12 are placed in two end sections of the antenna. The cross-axial positioned magnetic cores 12 are placed in one section sandwiched between the axial sections. In another embodiment of the current invention a steerable antenna consists of one axial section and two cross-axial sections of magnetic cores. The axial positioned magnetic cores are placed in one section in the middle of the antenna. The cross-axial positioned magnetic cores are made of two sections. The schematic antenna wire diagram is shown in FIG. 15. The steel housing 2, the magnetic cores 12, and winding wires 14 are not shown. The single antenna wire 121 is connected to a tuning circuit 119 that is further connected via a connector 120 to the transceiver circuit 122. The functions and operations of 121, 119, 120, and 122 are identical to 114, 112, 113, and 115 in FIG. 14. In addition, the z axis of a coordinate system 123 is the tool axis.

Figure 16:
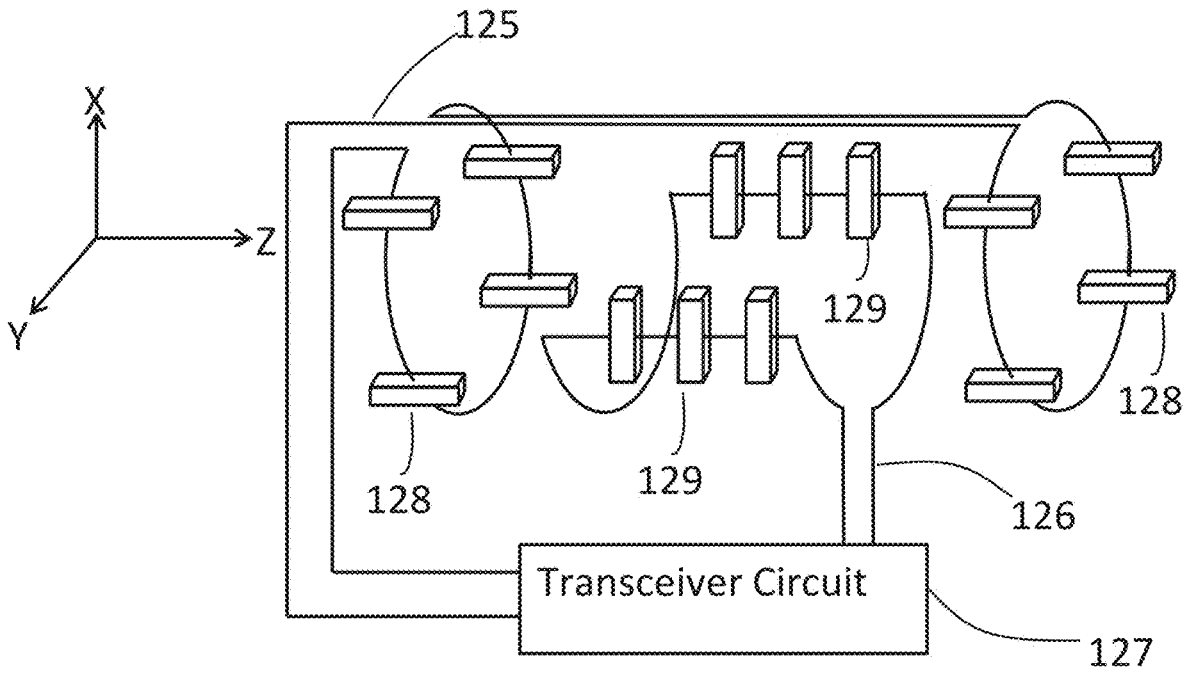
FIG. 16 is a schematic DC-current wire diagram of a steerable dipole antenna with two axial sections constructed in accordance with the present disclosure.

The magnetic cores 12 and the current wire routes corresponding to the antenna of FIG. 14 are shown in FIG. 16 schematically. The steel housing 2 of the antenna section, the antenna wire, and the winding 14 on the magnetic cores 12 are not shown in the figure. In this particular embodiment the windings 14 on all the axially positioned magnetic cores 128 are serially connected as a single wire 125. When a saturating current (e.g., DC current) is applied to wire 125 all the axial magnetic cores 12 are disabled. Without a current in wire 125 all the axial magnetic cores 12 are of high magnetic permeability. Similarly wire 126 serially connects windings on all the cross-axial magnetic cores 129. The cross-axial magnetic cores 129 as a single group is disabled or enabled by whether the transceiver circuit 127 applies a saturating current to wire 126.

Figure 17:
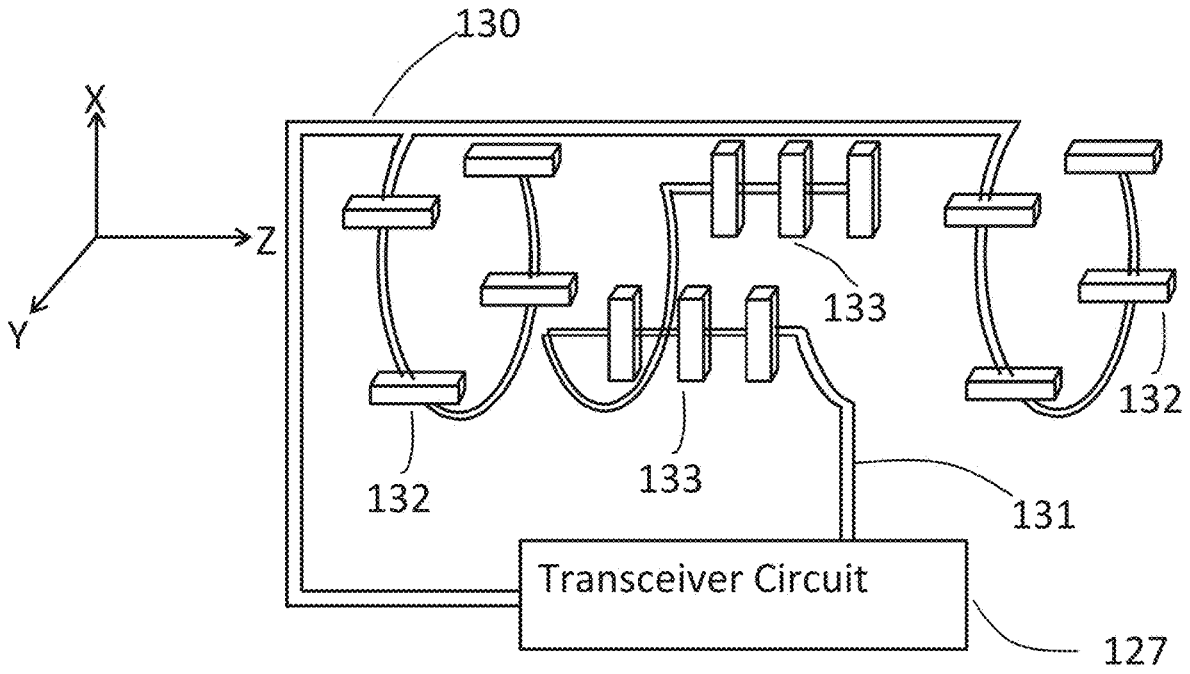
FIG. 17 is a schematic diagram showing wire routes corresponding to the antenna depicted in FIG. 14.

In another embodiment of the current invention the magnetic cores 12 and the current wire routes corresponding to the antenna of FIG. 14 are schematically shown in FIG. 17. As in FIG. 16, the steel housing 2 of the antenna section, the antenna wire, and the winding 14 on the magnetic cores 12 are not shown in the figure. In this embodiment, current wire 130 is the current wire for the axial positioned magnetic cores 132, and the cross-axial positioned magnetic cores 133 are controlled by the current wire 131. In every segment of the pathways between adjacent magnetic cores and between the transceiver circuit 127 and the sections of magnetic cores there are two segments of a current wire 130. In some embodiments, the currents in the two segments may be DC currents that are always the same in magnitude and are opposite in direction. The current supplied by the transceiver circuit 127 does not generate any magnetic field except inside the magnetic cores 12. There is no unwanted magnetic field by the current. The operation of any electronic components within the resistivity tool or nearby sensor is not interfered magnetically by the application of the current. Furthermore, no power is wasted on generating the unwanted magnetic field.

Various embodiments of the current invention have been described in detail. They serve to illustrate the spirit of the invention. The descriptions are examples on how the invention can be applied and are not meant to represent the scope of the invention. For example, in some embodiments several antennas in a set for a composite measurement such as a compensated difference construct on a LWD resistivity tool are assumed to be located linearly along a single direction. This invention, however, can be embodied in a system of antennas located in a two-dimensional or three-dimensional space. The scope of the invention shall be limited only by the claims.

The following references are hereby incorporated by reference in their entirety herein: U.S. Pat. No. 5,138,263 (August 1992), Towle; U.S. Pat. No. 5,331,331 (July 1994), Wu; U.S. Pat. No. 5,438,267 (August 1995), Wu; U.S. Pat. No. 5,491,488 (February 1996), Wu; U.S. Pat. No. 5,530,358 (June 1996), Wisler et al; U.S. Pat. No. 5,869,968 (February 1999), Brooks et al; U.S. Pat. No. 6,646,441 (November 2003), Thompson et al; U.S. Pat. No. 8,378,908 February 2013 Wisler et al; U.S. Pat. No. 8,471,563 (June 2013), Wisler et al; U.S. Pat. No. 8,604,796 (December 2013), Wisler et al; U.S. Pat. No. 9,140,817(September 2015), Wisler et al; U.S. Pat. No. 9,366,780 (June 2016), Wisler et al; U.S. Pat. No. 9,885,900 (February 2018), Wisler et al.

A numbered list of exemplary embodiments includes the following:

In embodiment 1, a method of sensing formation properties while drilling a well, the method comprising: disposing an antenna system on a drill collar segment, the antenna system comprising at least two transmitters and at least two receivers forming at least one compensated difference construct wherein at least one of the receivers in the compensated difference construct includes a switchable antenna; disposing a transceiver electronics system on the drill collar segment, the transceiver electronics system comprising: a subsystem for applying a saturating current to windings on a magnetic core of the switchable antenna; a receiver electronics unit; a transmitter electronics unit; and an electronic control unit, the electronic control unit configured to: manage measurement sequences at at-least one frequency during at-least one time period; and, process receiver data into output; and utilizing the antenna system and the transceiver electronics system to perform the measurement sequences at at-least one frequency and process receiver data into output, wherein the measurement sequences include at least one sequence during which the switchable antenna is turned off during a period of time by a saturating current applied to the windings of the magnetic core of the switchable antenna so as to magnetically saturate the magnetic core.

In embodiment 2, the method of embodiment 1, wherein the saturating current is a DC current, and wherein the measurement sequences include at least one sequence during which at least one switchable antenna is turned off during a period of time by a saturating DC current applied to the windings of the magnetic core of the switchable antenna so as to magnetically saturate the magnetic core.

In embodiment 3, the method of embodiment 1, wherein the directions of the saturation current on the magnetic core at separate time periods follow a prescribed pattern.

In embodiment 4, the method of embodiment 3, wherein the prescribed pattern includes a positive saturation current and a negative saturation current.

In embodiment 5, the method of embodiment 1, wherein both receivers of the at least one compensated construct are switchable antennas and each receiver is turned off during a period of time during the at least one sequence by a saturating current applied to the windings of the magnetic cores within the switchable receiver.

In embodiment 6, the method of embodiment 1, wherein the at least one sequence during which the at least one switchable antenna is turned off during the period of time is a Wu sequence.

In embodiment 7, the method of embodiment 5, wherein the at least one sequence during which each receiver is turned off during the period of time is a Wu sequence.

In embodiment 8, a method of sensing formation properties while drilling a well, the method comprising: disposing an antenna system on a drill collar segment, the antenna system comprising a first transmitter and a second transmitter and at least two receivers forming at least one reciprocal compensated difference construct wherein at least the first transmitter in the at least one reciprocal compensated difference construct includes a switchable antenna having windings on a transformer-like magnetic core; disposing a transceiver system on the drill collar segment, the transceiver system comprising: a receiver electronics unit, a transmitter electronics unit; an electronic control unit, the electronic control unit including electronics configured to manage measurement sequences at at-least one frequency; and, process receiver data into output; a subsystem for applying a saturating current to the windings on the magnetic core of the switchable antenna; and, utilizing the antenna system and the transceiver system to perform measurement sequences at at-least one frequency and process receiver data into output; and wherein the measurement sequences include at least one sequence during which at least one switchable antenna is turned off at a period of time by a saturating current applied to the windings of the transformer-like magnetic core of the switchable antenna.

In embodiment 9, the method of embodiment 8, wherein the saturating current is a DC current, and wherein the measurement sequences include at least one sequence during which at least one switchable antenna is turned off during a period of time by a saturating DC current applied to the windings of the transformer-like magnetic core of the switchable antenna so as to magnetically saturate the magnetic core.

In embodiment 10, the method of embodiment 8, wherein the switchable antenna is a first switchable antenna, the windings is a first winding, and the transformer-like magnetic core is a first transformer-like magnetic core, and wherein the second transmitter of the at least one reciprocal compensated construct includes a second switchable antenna having second windings on a second transformer-like magnetic core and the first switchable antenna and the second switchable antenna are turned off at periods of time during the at least one sequence by a saturating current applied to the first windings and the second windings.

In embodiment 11, the method of embodiment 8, wherein the at least one sequence during which the at least one switchable antenna is turned off during the period of time is a Wu sequence.

In embodiment 12, the method of embodiment 10, wherein the at least one sequence during which the first antenna and the second antenna are turned off during periods of time includes a Wu sequence.

In embodiment 13, a method of sensing formation properties while drilling a well, the method comprising: disposing an antenna system on a drill collar segment, the antenna system comprising at least one transmitter, a first receiver, and a second receiver wherein the first receiver includes a switchable antenna having windings on a transformer-like magnetic core having a closed loop about an elongated hole; disposing a transceiver electronics system on the drill collar segment, the transceiver electronics system comprising a receiver electronics unit, a transmitter electronics unit, and an electronic control unit, the electronic control unit configured for managing measurement sequences at at-least one frequency and for processing receiver data into output, the transceiver electronics system including a subsystem for applying a saturating current to the windings during a period of time of the measurement sequences; utilizing the antenna system and the transceiver electronics system to perform measurement sequences at at-least one frequency and process receiver data into output; and, wherein the measurement sequences include at least one sequence during which the subsystem applies the saturating current to the windings.

In embodiment 14, the method of embodiment 13, wherein the saturating current is a DC current, and wherein the measurement sequences include at least one sequence during which the subsystem applies the saturating current to the windings.

In embodiment 15, the method of embodiment 13 wherein the switchable antenna is a first switchable antenna, the windings are first windings, and the transformer-like magnetic core is a first transformer-like magnetic core, and wherein the second receiver includes a second switchable antenna having second windings on a second transformer-like magnetic core, and wherein the subsystem applies the saturating current to the first windings and the second windings during periods of time of the measurement sequences.

In embodiment 16, a method of sensing formation properties while drilling a well, the method comprising: disposing an antenna system on a drill collar segment, the antenna system comprising at least two transmitters and at least one receiver wherein a first transmitter of the transmitters includes a switchable antenna having windings on a transformer-like magnetic core having a continuous loop around an elongated hole; disposing a transceiver electronics system on the drill collar segment, the transceiver electronics system comprising a receiver electronics unit, a transmitter electronics unit, and an electronic control unit, the electronic control unit configured for managing measurement sequences at at-least one frequency and for processing receiver data into output, the transceiver electronics system further including a subsystem for applying a saturating current to windings on the magnetic core of the switchable antenna; utilizing the antenna system and the transceiver electronics system to perform measurement sequences at at-least one frequency and process receiver data into output; and, wherein the measurement sequences include at least one sequence during which the subsystem supplies the saturating current to the windings.

In embodiment 17, the method of embodiment 16, wherein the saturating current is a DC current, and wherein the measurement sequences include at least one sequence during which the subsystem supplies the saturating current to the windings.

In embodiment 18, the method of embodiment 16 wherein the switchable antenna is a first switchable antenna, the windings are first windings, the transformer-like magnetic core is a first transformer-like magnetic core, and further wherein a second transmitter of the transmitters includes a second switchable antenna having second windings on a second transformer-like magnetic core and wherein the subsystem supplies the saturating current to the second windings.

In embodiment 19, a method of sensing formation properties while drilling a well, the method comprising: disposing an antenna system on a drill collar segment, the antenna system comprising at least a first set of antennas and a second set of antennas wherein at least one of the antennas in the first set of antennas is a switchable antenna; disposing a transceiver electronics system on the drill collar segment, the transceiver electronics system comprising a receiver electronics unit, a transmitter electronics unit, and an electronic control unit, the electronic control unit configured for managing measurement sequences at at-least one frequency and for processing receiver data into output, the transceiver electronics system including a subsystem for applying a saturating current to windings on a magnetic core of the switchable antenna; utilizing the antenna system and the transceiver electronics system to perform measurement sequences at at-least one frequency and process receiver data into output; and, wherein the measurement sequences include at least one sequence during which at least one switchable antenna of the first set of antennas is turned off at one time by a saturating current applied to windings on a magnetic core of the switchable antenna. In embodiment 20, the method of embodiment 19, wherein the saturating current is a DC current, and wherein the measurement sequences include at least one sequence during which at least one switchable antenna of the first set of antennas is turned off at one time by the saturating current applied to windings on a magnetic core of the switchable antenna.

In embodiment 21, the method of embodiment 19, wherein the first set of antennas forms a construct selected from a list of constructs including a compensated difference construct and a reciprocal compensated difference construct.

In embodiment 22, the method of embodiment 19, wherein the second set of antennas forms a construct selected from a list of constructs including a compensated difference construct and a reciprocal compensated difference construct.

In embodiment 23, the method of embodiment 19 wherein the first set of antennas forms a first construct selected from a first list of constructs including a compensated difference construct and a reciprocal compensated difference construct; and, the second set of antennas forms a second construct selected from a second list of constructs including a compensated difference construct and a reciprocal compensated difference construct.

In embodiment 24, the method of embodiment 23 wherein the first construct and the second construct share at least one antenna.

In embodiment 25, the method of embodiment 23 wherein the first construct and the second construct share at least two receivers.

In embodiment 26, the method of embodiment 23 wherein the first construct and the second construct share at least two transmitters.

In embodiment 27, a method of electromagnetic sensing, the method comprising: disposing an antenna system with at least three antennas comprising at least one transmitter antenna and at least one receiver antenna wherein at least one of the antennas is a switchable antenna; connecting the antenna system to a transceiver electronics system, the transceiver electronics system comprising a receiver electronics unit, a transmitter electronics unit, and an electronic control unit, the electronic control unit configured for managing measurement sequences at at-least one frequency and for processing receiver data into output, the transceiver electronics system including a subsystem for applying a saturating current to windings on magnetic cores of individual switchable antennas; utilizing the antenna system and the transceiver electronics system to perform measurement sequences at at-least one frequency and process receiver data into output; and, wherein the measurement sequences include at least one sequence during which at least one switchable antenna is turned off at one time by a saturating current applied to the windings of the magnetic cores within the at least one switchable antenna.

In embodiment 28, the method of embodiment 27, wherein the saturating current is a DC current, and wherein the measurement sequences include at least one sequence during which at least one switchable antenna is turned off at one time by the saturating current applied to the windings of the magnetic cores within the at least one switchable antenna.

In embodiment 29, the method of embodiment 27 wherein the at least one transmitter antenna comprises at least two transmitters and at least one of the transmitters is a switchable antenna.

In embodiment 30, the method of embodiment 27 wherein the at least one receiver antenna comprises at least two receivers and at least one of the receivers is a switchable antenna.

In embodiment 31, a method of sensing formation properties while drilling a well, the method comprising: disposing an antenna system on a drill collar segment, the antenna system comprising at least one transmitter antenna for creating an electromagnetic field and at least one receiver antenna for detecting an electromagnetic field; disposing a transceiver electronics system on the drill collar segment, the transceiver electronics system comprising a receiver electronics unit, a transmitter electronics unit, and an electronic control unit, the electronic control unit configured for managing measurement sequence at at-least one frequency and for processing receiver data into output; wherein at least one of the transmitter antenna or the receiver antenna in the antenna system is a magnetic dipole based antenna comprising several slot based magnetic dipoles, the slot based magnetic dipoles comprising: a first set of slots in an axial direction in an outer surface of the drill collar segment and a second set of slots pointing in a cross-axial direction; a plurality of wire holes beneath the outer surface connecting adjacent slots and connecting slots with the transceiver electronics system; magnetic cores positioned in at least one set of slots, at least some of the magnetic cores formed as a continuous loop of magnetic material around an elongated hole; a continuous antenna wire passing through the first set of slots and the second set of slots; wherein the magnetic cores positioned in the at least one of the sets of slots are grouped into a subset and windings on the magnetic cores in the subset are connected in series and further connected to the transceiver electronic system; and, wherein the transceiver electronics system further comprises a subsystem that connects to the windings of the subset and applies at least once a saturating current in a measurement sequence to the windings of the subset.

In embodiment 32, the method of embodiment 31, wherein the saturating current is a DC current, and wherein the subsystem that connects to each winding wire of the subset and applies at least once a saturating current in a measurement sequence to the winding wire of the subset.

In embodiment 33, the method of embodiment 31 wherein the second set of slots includes a plurality of magnetic cores positioned in a cross-axial direction and in a measurement sequence at least a portion of the plurality of magnetic cores in the second set of slots are switched off.

In embodiment 34, the method of embodiment 31 wherein the first set of slots includes a plurality of magnetic cores positioned in an axial direction and in a measurement sequence at least a portion of the plurality of magnetic cores in the first set of slots are switched off.

In embodiment 35, the method of embodiment 31 wherein the first set of slots pointing in an axial direction is located in two sections along the drill collar segment axially and the second set of slots pointing in a cross-axial direction is located in one section between the two sections of the first set of slots.

In embodiment 36, the method of embodiment 31 wherein the second set of slots pointing in an cross-axial direction is located in two sections along the drill collar segment axially and the first set of slots pointing in an axial direction is located in one section between the two sections of the second set of slots.

In embodiment 37, the method of embodiment 31 wherein the continuous antenna wire passing through both sets of the slots via the wire holes in a first route and turns around to repass through both sets of the slots and wire holes via a second route, wherein a first wire segment is positioned below each magnetic core in each slot and a second wire segment is positioned above each magnetic core in each slot.

What is claimed is:

1. A method of sensing formation properties while drilling a well, the method comprising:

disposing an antenna system on a drill collar segment, the antenna system comprising at least two transmitters and at least two receivers forming at least one compensated difference construct wherein at least one of the at least two receivers in the at least one compensated difference construct includes a switchable antenna;

disposing a transceiver electronics system on the drill collar segment, the transceiver electronics system comprising:

a subsystem for applying a saturating current to windings on a magnetic core of the switchable antenna;

a receiver electronics unit;

a transmitter electronics unit; and an electronic control circuitry, the electronic control circuitry configured to:

manage measurement sequences at at-least one frequency during at-least one time period; and, process receiver data into output; and utilizing the antenna system and the transceiver electronics system to perform the measurement sequences at the at-least one frequency and process the receiver data into the output, wherein the measurement sequences include at least one sequence during which the switchable antenna is turned off during a period of time by the saturating current applied to the windings on the magnetic core of the switchable antenna so as to magnetically saturate the magnetic core.

2. The method of claim 1, wherein the saturating current is a direct current (DC) current, and wherein the measurement sequences include the at least one sequence during which the switchable antenna is turned off during the period of time by the DC current applied to the windings on the magnetic core of the switchable antenna so as to magnetically saturate the magnetic core.

3. The method of claim 1, wherein directions of the saturating current on the magnetic core at separate time periods follow a prescribed pattern.

4. The method of claim 3, wherein the prescribed pattern includes a positive saturating current and a negative saturating current.

5. The method of claim 1, wherein the at least two receivers of the at least one compensated difference construct are switchable antennas and each receiver of the at least two receivers is turned off during the period of time during the at least one sequence by the saturating current applied to the windings on the magnetic core within the switchable antenna.

6. The method of claim 5, wherein the at least one sequence during which said each receiver of the at least two receivers is turned off during the period of time is a Wu sequence.

7. The method of claim 1, wherein the at least one sequence during which the switchable antenna is turned off during the period of time is a Wu sequence.

8. A method of sensing formation properties while drilling a well, the method comprising:

disposing an antenna system on a drill collar segment, the antenna system comprising a first transmitter and a second transmitter and at least two receivers forming at least one reciprocal compensated difference construct wherein at least the first transmitter in the at least one reciprocal compensated difference construct includes a switchable antenna having windings on a transformer-like magnetic core;

disposing a transceiver system on the drill collar segment, the transceiver system comprising:

a receiver electronics unit, a transmitter electronics unit;

an electronic control circuitry, the electronic control circuitry including electronics configured to manage measurement sequences at at-least one frequency, and, process receiver data into output; and a subsystem for applying a saturating current to the windings on the transformer-like magnetic core of the switchable antenna; and, utilizing the antenna system and the transceiver system to perform the measurement sequences at the at-least one frequency and process the receiver data into the output, wherein the measurement sequences include at least one sequence during which the switchable antenna is turned off at a period of time by the saturating current applied to the windings on the transformer-like magnetic core of the switchable antenna.

9. The method of claim 8, wherein the saturating current is a saturating direct current (DC) current, and wherein the measurement sequences include the at least one sequence during which the switchable antenna is turned off during the period of time by the DC current applied to the windings on the transformer-like magnetic core of the switchable antenna so as to magnetically saturate the transformer-like magnetic core.

10. The method of claim 8, wherein the switchable antenna is a first switchable antenna, the windings is first windings, and the transformer-like magnetic core is a first transformer-like magnetic core, and wherein the second transmitter of the at least one reciprocal compensated difference construct includes a second switchable antenna having second windings on a second transformer-like magnetic core and the first switchable antenna and the second switchable antenna are turned off at periods of time during the at least one sequence by the saturating current applied to the first windings and the second windings.

11. The method of claim 8, wherein the at least one sequence during which the first switchable antenna is turned off during the period of time is a Wu sequence.

12. The method of claim 10, wherein the at least one sequence during which the first switchable antenna and the second switchable antenna are turned off during the periods of time includes a Wu sequence.

13. A method of sensing formation properties while drilling a well, the method comprising:

disposing an antenna system on a drill collar segment, the antenna system comprising at least one transmitter, a first receiver, and a second receiver forming at least one reciprocal compensated difference construct wherein the first receiver in the at least one reciprocal compensated difference construct includes a switchable antenna having windings on a transformer-like magnetic core having a closed loop about an elongated hole;

disposing a transceiver electronics system on the drill collar segment, the transceiver electronics system comprising:

a receiver electronics unit, a transmitter electronics unit, and an electronic control circuitry, the electronic control circuitry configured for managing measurement sequences at at-least one frequency and for processing receiver data into output, the transceiver electronics system including a subsystem for applying a saturating current to the windings on the transformer-like magnetic core of the switchable antenna during a period of time of the measurement sequences; and, utilizing the antenna system and the transceiver electronics system to perform the measurement sequences at the at-least one frequency and process the receiver data into the output, wherein the measurement sequences include at least one sequence during which the switchable antenna is turned off at the period of time by the subsystem applying the saturating current to the windings on the transformer-like magnetic core.

14. The method of claim 13, wherein the saturating current is a direct current (DC) current, and wherein the measurement sequences include the at least one sequence during which the subsystem applies the saturating current to the windings.

15. The method of claim 13, wherein the switchable antenna is a first switchable antenna, the windings are first windings, and the transformer-like magnetic core is a first transformer-like magnetic core, and wherein the second receiver includes a second switchable antenna having second windings on a second transformer-like magnetic core, and wherein the subsystem applies the saturating current to the first windings and the second windings during periods of time of the measurement sequences.

* * * * *